US006088938A

United States Patent [19]

Logan

[11] Patent Number: 6,088,938

[45] Date of Patent: Jul. 18, 2000

[54] IMPLEMENT ADAPTER FOR AN EXCAVATION TOOL ASSEMBLY

[76] Inventor: John Duncan Logan, P.O. Box 392, Seward, Ak. 99664

[21] Appl. No.: 09/116,957

[22] Filed: Jul. 17, 1998

[51] Int. Cl.[7] ..... E02F 3/76

[52] U.S. Cl. ..... 37/468; 37/407; 37/404; 403/24

[58] Field of Search ..... 37/468, 404, 405, 37/403, 379, 407, 410; 403/24

[56] References Cited

U.S. PATENT DOCUMENTS

| | | | |
|---|---|---|---|
| 2,644,251 | 7/1953 | Smith | 37/404 |
| 2,986,826 | 6/1961 | Timmons . | |
| 3,039,210 | 6/1962 | Slaughter | 37/404 |
| 3,043,032 | 7/1962 | Discenza | 37/404 |
| 3,181,256 | 5/1965 | Discenza | 37/404 |
| 3,195,250 | 7/1965 | Robinson . | |
| 3,469,330 | 9/1969 | Hood et al. | 37/404 |
| 3,523,380 | 8/1970 | Bolyard et al. | 37/403 |
| 3,665,622 | 5/1972 | Lamb | 52/210 |
| 3,864,793 | 2/1975 | Guest . | |
| 3,915,501 | 10/1975 | Cobb et al. | 299/67 |
| 4,009,529 | 3/1977 | Johnson | 37/404 |
| 4,087,010 | 5/1978 | Stormon | 414/722 |
| 4,100,688 | 7/1978 | Grist . | |
| 4,125,952 | 11/1978 | Jennings | 37/405 |
| 4,360,980 | 11/1982 | Jarvis | 37/404 |
| 4,550,512 | 11/1985 | Felstet | 37/403 |
| 4,974,349 | 12/1990 | Timmons | 37/379 |
| 5,253,449 | 10/1993 | Webb et al. | 37/446 |
| 5,297,351 | 3/1994 | Côté | 37/232 |
| 5,515,626 | 5/1996 | Hölscher | 37/468 |
| 5,544,435 | 8/1996 | Somero | 37/405 |
| 5,561,926 | 10/1996 | Stratti | 37/468 |
| 5,596,825 | 1/1997 | Von Schalscha | 37/407 |
| 5,615,499 | 4/1997 | McGuire et al. | 37/468 X |
| 5,639,205 | 6/1997 | Kaczmarczyk et al. | 414/723 |
| 5,674,046 | 10/1997 | Meyer | 37/468 X |
| 5,678,332 | 10/1997 | Hawkins | 37/403 |
| 5,692,850 | 12/1997 | Kimble et al. | 37/468 X |
| 5,779,429 | 7/1998 | Poole | 37/468 X |

*Primary Examiner*—Christopher J. Novosad
*Attorney, Agent, or Firm*—Donald J. Lecher

[57] ABSTRACT

An implement adapter for providing improved excavation versatility that couples with and attaches to an excavation tool assembly for mounting a working implement thereon. The implement adapter comprises a frame for holding a working implement, wherein the frame is coupled and semi-fixedly attached to an excavation tool assembly. A parking projection holds the coupling element of the frame at a sufficient height above a surface when the implement adapter is detached from the excavation tool assembly and supported on the surface by the parking projection and a lowermost portion of either the frame or the working implement. The height at which the coupling portion is held by the parking projection enables engagement of the coupling portion with a cooperative coupling element on the excavation tool assembly without the need for any manual assistance. Additionally, the implement adapter is capable of mounting upon various sizes of excavation tools and articulating attached working implements in multiple ranges of motion.

36 Claims, 13 Drawing Sheets

10
19
50
53
56
57
61
66
67
69
80
81
82
13
D

IMPLEMENT ADAPTER FOR AN EXCAVATION TOOL ASSEMBLY

BACKGROUND OF THE INVENTION

1. Field of Invention

The present invention pertains to the field of art encompassing earth-moving machines and more particularly to excavation tool assemblies, for example, of the kind comprising excavation buckets and excavation thumbs to which working implements are mounted thereon. The present invention relates to a detachable implement adapter that is initially coupled to a excavation bucket or an excavation thumb of an excavation tool assembly without the need for manual assistance. Additionally, the implement adapter provides improved excavation versatility by mounting upon various sizes of excavation tools and articulating attached working implements in multiple ranges of motion.

2. General Background and Discussion of Prior Art

In the past, implements themselves have been mounted directly on excavation buckets utilizing a unitary constructed implement fastened directly to a bucket with a plurality of manually connected fasteners. This attachment method creates a labor and time intensive process of installation or detachment of the heavy working implements designed to withstand the bending influence during operation. As a result of the implements' heavy weight, the manual labor of several persons is required to position and fasten the implement on the excavation tool. The unitary construction of such implements also results in costly replacement or repairing after appreciable wear of the cutting edge has taken place.

Examples of what is known in the prior art showing a blade implement for attachment directly to an excavation bucket, are as follows: Smith, U.S. Pat. No. 2,644,251, Discenza, U.S. Pat. Nos. 3,043,032 & 3,181,256; Slaughter, U.S. Pat. No. 3,039,210; Hood et al., U.S. Pat. No. 3,469,330; Bolyard et al., U.S. Pat. No. 3,523,380; Johnson, U.S. Pat. No. 4,009,529; Jarvis, U.S. Pat. No. 4,360,980; Webb et al., U.S. Pat. No. 5,253,449; Cote, U.S. Pat. No. 5,297,351; and Von Schalscha, U.S. Pat. No. 5,596,825. Felstet, U.S. Pat. No. 4,550,512 teaches an excavator bucket with interchangeably detachable implements connecting directly to the excavator bucket. Jennings, U.S. Pat. No. 4,125,952 teaches a fork type implement for attachment to an excavator bucket. Timmons, U.S. Pat. No. 4,974,349 teaches a compactor attached to the back of an excavator bucket. Stormon, U.S. Pat. No. 4,087,010 teaches an apparatus for mounted hand held tools to an excavator bucket.

Implements have also been directly mounted on excavation thumbs of excavation tool assemblies. Cobb et al., U.S. Pat. No. 3,915,501 teaches an impact rock breaker integral with a thumb-like structure. Somero, U.S. Pat. No. 5,544,435 teaches a brush rake directly attached to a thumb portion of an excavation tool assembly. Hawkins, U.S. Pat. No. 5,678,332 teaches a changeable and retractable implement for use on a thumb portion of an excavation tool assembly. However, the prior art fails to teach an adjustable adapter for mounting to excavation tool assembly thumbs of different sizes and the ability to mount interchangeable working implements.

Implements have also been attached to cumbersome mounting devices designed for a single excavation bucket. Lamb, U.S. Pat. No. 3,665,622 teaches a device for mounting to a lift bucket upon which a working implement is attached. However, Lamb's mounting bracket fails to have any adjustable feature allowing for adaptation on excavation buckets of different sizes. Additionally, the mounting arrangement of the working implement on this mounting device fails to allow for any type of articulation of the implement relative to the mounting device.

Finally, none of the prior art teaches an implement adapter for mounting on an excavation tool assembly where the adapter's geometry automatically holds the adapter at in a position to be engaged by the excavation tool assembly without any need of manual assistance. Kaczmarczyk et al., U.S. Pat. No. 5,639,205 teaches a parkable grapple for attachment to a front-end loader holder, having a parking foot (ref. no. 102) for holding the detached grapple at a certain height for engagement with the front-end loader holder.

OBJECTS AND ADVANTAGES

It is the principle object of the present invention to provide an implement adapter for having a coupling attachment and method of attachment to an excavation tool assembly wherein there is no need for manual assistance.

It is a further object of the present invention to provide an implement adapter that accommodates the rotatable articulation of mounted implements.

It is a further object of the present invention to provide a multipoint progressive loading connection between the implement adapter and the excavation tool assembly to eliminate excessive wear at high stress engagement points, thereby increasing the useful field life of the excavation tool assembly and the implement adapter.

It is a further object of the present invention to provide a multipoint progressive loading connection between the implement adapter and the excavation tool assembly to eliminate vibratory generated squeaks and rattles caused by the engagement points.

It is a further object of the present invention to provide a smaller overall dimension of the implement adapter relative to the prior art for improved maneuverability of the implement when in operation.

It is a further object of the present invention to provide a more closely aligned transmitted lateral force from the implement to the forward cutting edge of the excavation tool thereby lessening the torsional stress on the implement adapter under load.

It is a further object of the present invention to provide a manner of attachment of the implement adapter to the excavation tool assembly which provides for a quick and simple means for moving the implement adapter without manual assistance, e.g., from a transportable storage position to a temporary accessible position in the work field.

It is a further object of the present invention to provide for fully automatic engagement of the implement adapter to the excavation tool assembly with no need for manual assistance.

It is a further object of the present invention to provide an adjustable implement adapter that can be used on more than one differently dimensioned excavation tool, e.g., on excavation buckets and excavation thumbs.

It is a further object of the present invention to provide an adjustable implement adapter which enables the manufacture of a universal implement adapter for adjustment to fit a wide range of sizes of excavation tools with the option of permanently affixing the adjustable frame once it has been sized for a particular excavation tool.

It is a further object of the present invention to provide for improved load distribution upon the implement adapter during earth moving operations to reduce high concentrations of stress where the implement and implement adapter are connected.

It is a further object of the present invention to provide an excavation thumb mounted implement adapter which eliminates the need to remove the implement adapter from the excavation tool assembly when the bucket is desired be used.

It is a further object of the present invention to provide an excavation thumb mounted implement adapter to accommodate various excavation thumb configurations.

It is a further object of the present invention to provide an excavation thumb mounted implement adapter that enables the unhindered operation of the excavation thumb without interference of the mounted implement.

SUMMARY OF THE PRESENT INVENTION

The herein disclosed and claimed implement adapter for an excavation tool assembly of universal applicability readily accommodating mounting to a wide variety of excavation buckets (the like of which includes, but is not limited to, track loaders, backhoes, excavators, wheel loaders and skid steer loaders), and accommodating a wide variety of working implements mounted thereon. The implement adapter comprises a frame means adapted to hold a desired working implement, coupling and attachment means integral with the frame means for affixing to an excavation tool assembly, and parking means for holding the coupling means at a sufficient height above a surface when the implement adapter is detached from the excavation tool assembly and supported on the surface by the parking means and said lowermost portion of either the frame means or the implement. The height at which the coupling means is held by the parking means enables engagement of the coupling means with a cooperative coupling means on the excavation tool assembly without the need for any manual assistance.

DETAILED DESCRIPTION OF THE PREFERRED EMBODIMENT

Figure 1:
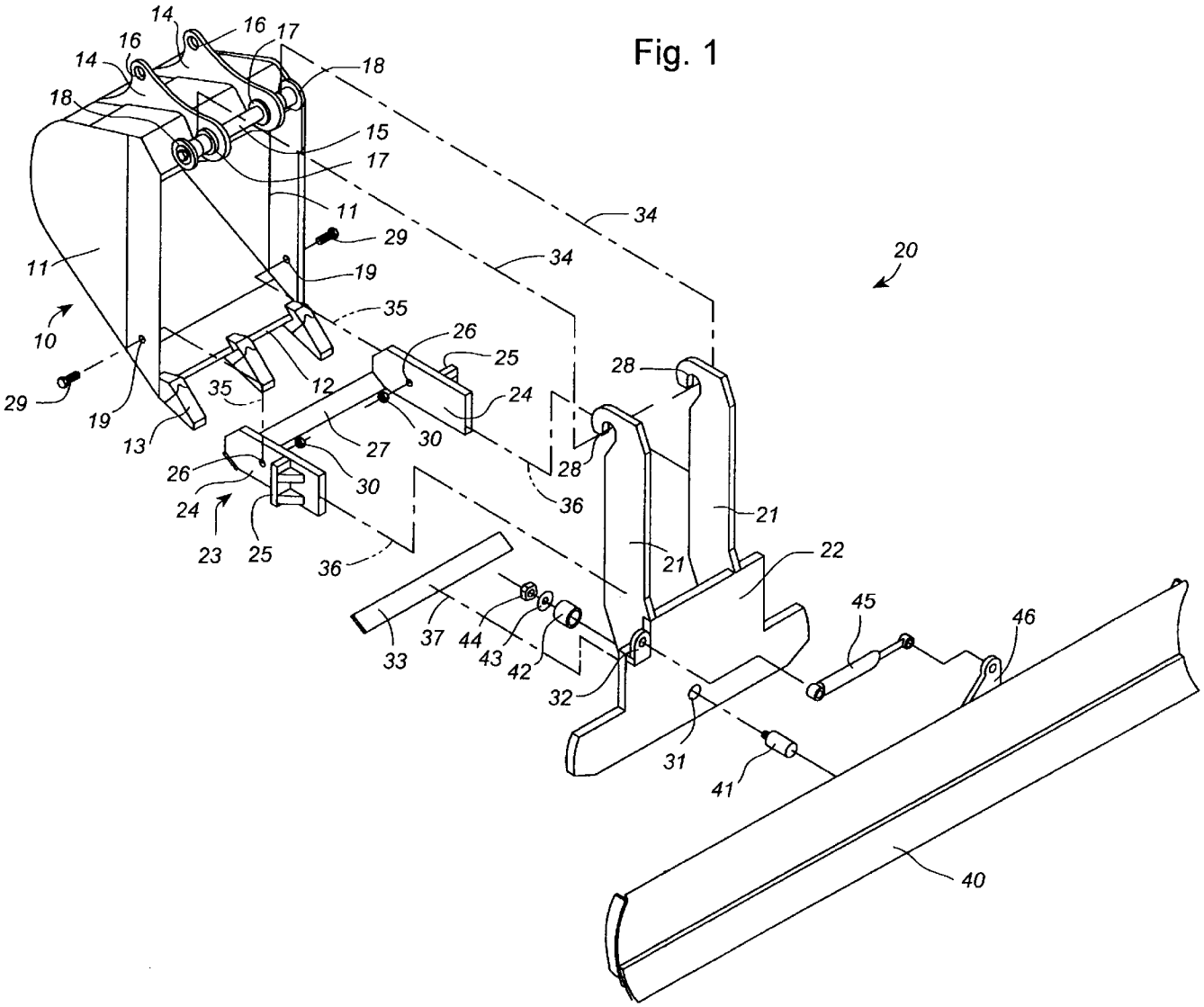
FIG. 1 Perspective exploded view of the fixed frame implement adapter for attachment to the bucket pivot pin with a hydraulically tilting blade.
Figure 3:
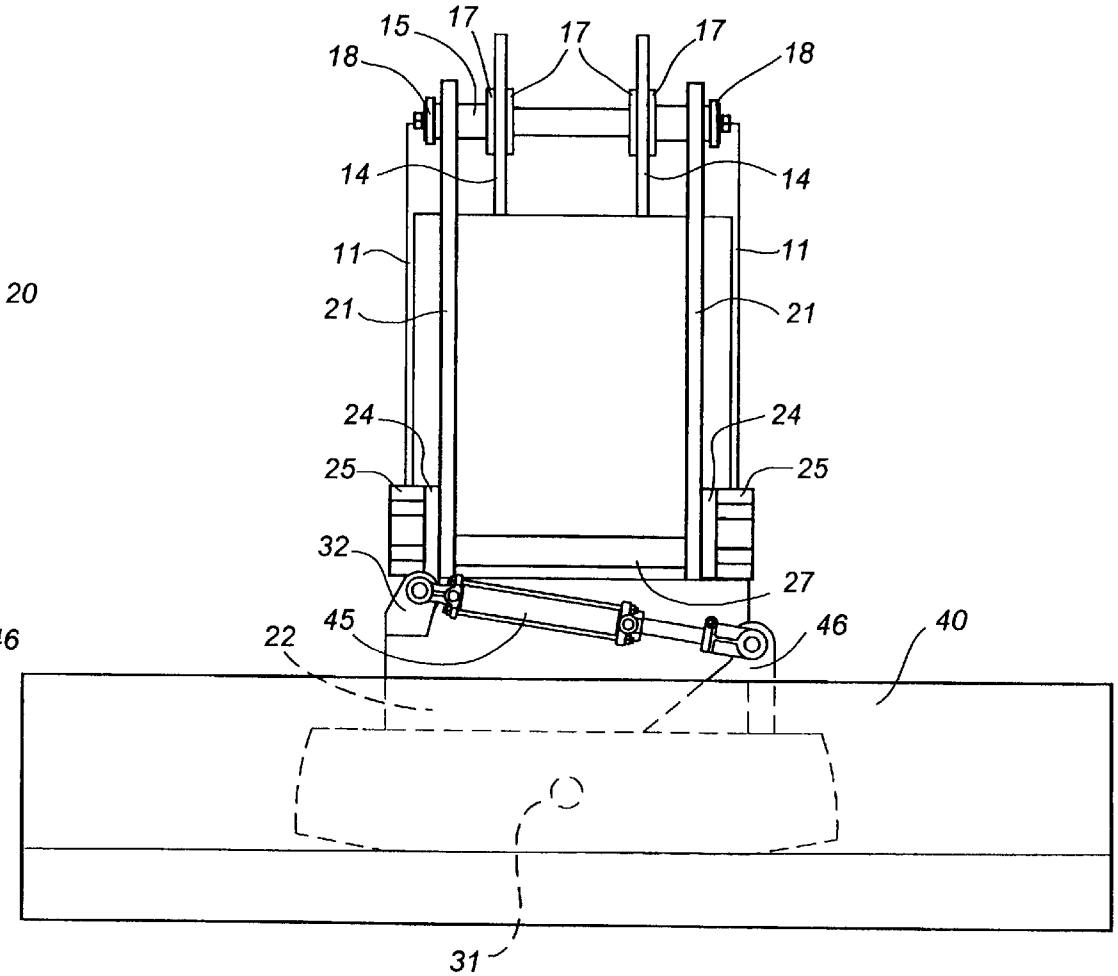
FIG. 3 Front view of the fixed frame implement adapter attached to the bucket pivot pin with a hydraulically tilting blade.
Figure 2:
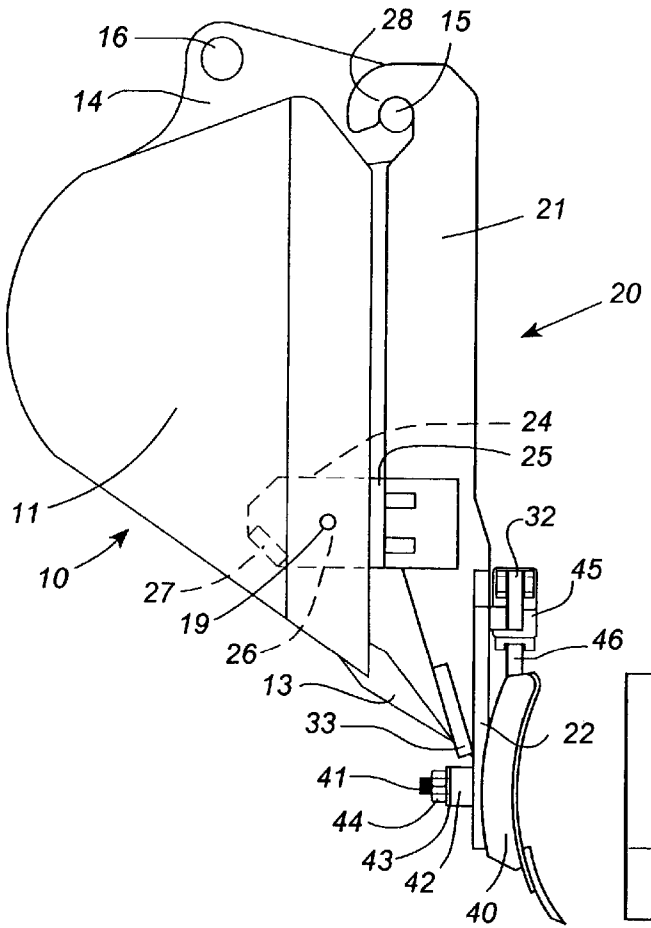
FIG. 2 Side view of the fixed frame implement adapter attached to the bucket pivot pin with a hydraulically tilting blade.

FIGS. 1–3. Description of a Fixed Frame Implement Adapter for Attachment to an Excavation Tool Wrist Pin An excavation bucket 10 has an open front defined by two opposed side edges 11, a lower cutting edge 12 with a plurality of teeth 13, and an upper edge opposite the lower cutting edge 12 where bucket attachment flanges 14 are integrally mounted. An exemplary embodiment of the invention comprises an excavation machine boom arm (not shown) attached to the excavation bucket 10 at wrist pin 15 mounted through a forward a set of attachment holes (similar to the rearward set of attachment holes 16) on the attachment flanges 14. The wrist pin 15 is retained on the attachment flanges 14 by pin retainers 17 which are fixedly attached to wrist pin 15 on both inwardly and outwardly facing sides of the bucket attachment flanges 14 to prevent pin 15 from moving laterally out of connection within the forward set of attachment holes of the attachment flanges 14. Located on both distil ends of the wrist pin 15 are pin end stops 18 which are fixedly attached to the wrist pin 15 and project radially therefrom. The excavation bucket 10 described in this disclosure is similar to many other excavation buckets for use on excavation machines, which includes, but is not limited to, track loaders, backhoes, excavators, wheel loaders and skid steer loaders.

A fixed frame implement adapter 20 is provided with a frame comprising two parallel frame arms 21, an implement mounting plate 22 connected to a forward lower portion of the frame arms 21, and a lower connecting assembly 23 connected to a rearward lower portion of the frame arms 21 as indicated by path lines 36.

The lower connecting assembly 23 comprises parallel lower connecting assembly arms 24 each attached to and rearwardly projecting from the lower portion of the frame arms 21. Midway on the outside of each of the lower connecting assembly arms 24 are outwardly projecting abutment tabs 25. Between each of the abutment tabs 25 and the distil ends of lower connecting assembly arms 24 are connecting holes 26. Between each distil end of the lower connecting assembly arms 24 is a spanner 27.

The fixed frame implement adapter 20 is first attached to the excavation bucket 10 at the wrist pin 15 by means of coupling yokes 28 at upper rearward portions of each frame arm 21, as indicated by path lines 34. The open portions of the coupling yokes 28 are rotatably coupled with the wrist pin 15, wherein with each coupling yoke 28 engages opposite ends of wrist pin 15 between the pin retainer 17 and the pin end stop 18.

Excavation machines that fail to have a wrist pin in a position proximate the upper edge of an excavation bucket opening can be adapted to mount a rod structure on the upper edge of an excavation bucket to functionally replace the wrist pin 15 described above. Thus, after mounted a coupling rod structure at an appropriate position, excavation tools having different articulation geometries can be easily adapted to receive the coupling yokes 28.

Implement adapter 20 is finally attached to excavation bucket 10 by means of the lower connection assembly 23 moving along an angular path, defined by coupling yokes 28 rotatably engaging wrist pin 15, wherein the lower connecting assembly arms 24 move into the excavation bucket 10 front opening until the abutment tabs 25 contact the front edge of the bucket side edges 11. In this contacted position, connecting holes 26 of the lower connecting assembly 23 are aligned with the excavation bucket side edge attachment holes 19. Fasteners 29 are then inserted into bucket attachment holes 19 and lower connecting assembly connecting holes 26 and are fixedly retained with nuts 30, as illustrated by path lines 35.

An alternative means for affixing the lower connection assembly 23 to the lower front edge portion of the bucket replaces the manually positioned fasteners 29 with a hydraulic actuation assembly mounted on the implement adapter that automatically engages the connecting holes 19 of the excavation bucket 10. This enables the final connection step of the implement adapter to be made completely automatic, thus eliminating the need for manual assistance for attachment and removal of the implement adapter from the excavation tool.

A blade-type implement 40 is rotationally attached to a lower central portion of the implement mounting plate 22 by means of a stud 41 fixedly attached to the back of the implement 40, for passage through a hole 31 in a center lower portion of the implement mounting plate 22 and into a collar 42 fixedly attached to the rearwardly facing surface of the implement mounting plate 22. A threaded distal end portion of stud 41 projects rearwardly past collar 42 for engagement with a washer 43 and nut 44 (FIG. 2) for rotationally securing implement 40 relative to the forward surface of implement mounting plate 22.

Implement 40 is able to be rotated with a hydraulic actuating component 45 coupled to a hydraulic implement connection 46 mounted a longitudinal distance on the implement 40 away from the stud 41, and to a hydraulic frame connection 32. Through standard means of hydraulic actuation, implement 40 is able to be rotated around the longitudinal axis of stud 41 while mounted on the implement mounting plate 22 of the fixed frame implement adapter 20.

Connecting holes 26 of the lower connecting assembly 23 are designed to loosely receive fastener 29 such that the lower connecting assembly 23 is able to move a small incremental amount while connected to and with respect to bucket 10. This loose fitting allows for movement of the lower connecting assembly 23, and thus the implement adapter 20, relative to the forward edge of the bucket side edges 11. Upon loading of the implement 40, abutment tabs 25 move into engagement with the forward edge of bucket side edges 11. Upon a further increase in the transferred loading force generated by the implement 40, a pressure plate 33 fixedly attached (as illustrated by path line 37) to a lower rearward portion of the frame arms 21 (see FIG. 2) engages teeth 13 along the lower cutting edge 12 of the excavation bucket 10. In this loading situation, the implement adapter 20 is restrained from moving in a forward direction at the coupling of the bucket wrist pin 15 and the coupling yokes 28 due to the contacting fulcrum point of the abutment tabs 25 on the front edge of the bucket side edges 11, while a majority of the force generated by the implement 40 is transferred via the pressure plate 33 through teeth 13 to the lower cutting edge 12.

This multipoint progressive loading design better distributes the implement generated force across the bucket geometry eliminating excessive wear at high stress engagement points on the implement adapter and excavation tool, thereby increasing their useful field life, and eliminating vibratory generated squeaks and rattles during operation at engagement points throughout all stages of loading the implement adapter.

Figure 5:
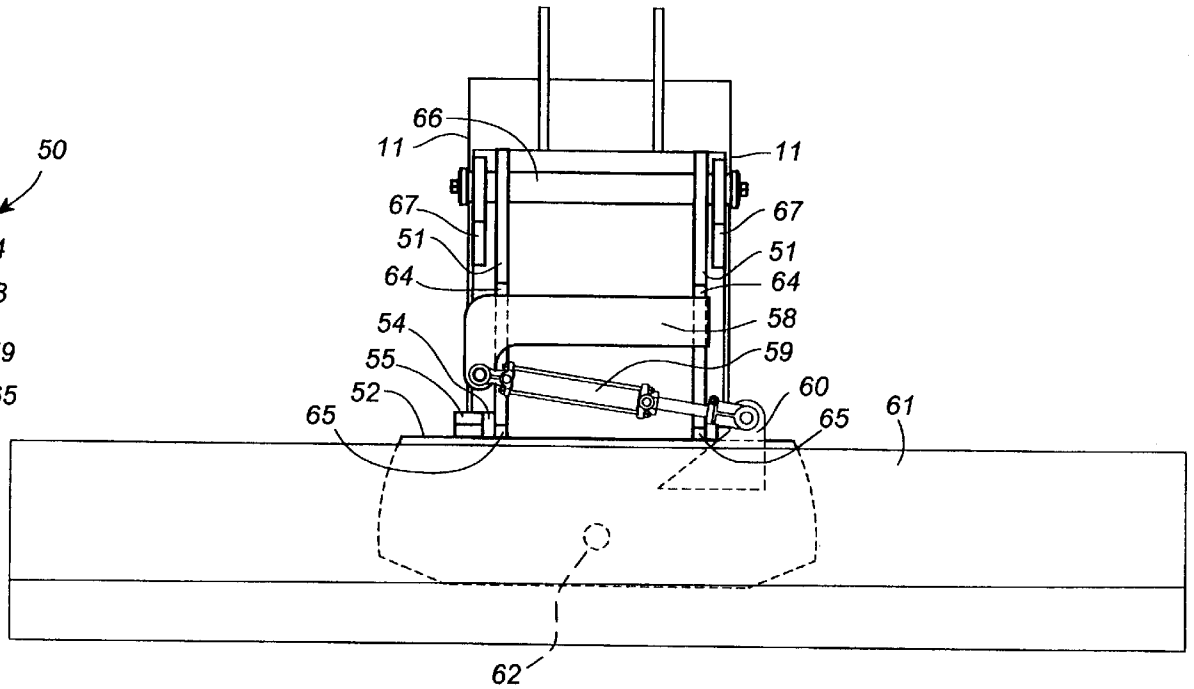
FIG. 5 Front view of an alternative embodiment fixed frame implement adapter attached to bucket brackets with a hydraulically tilting blade.
Figure 4:
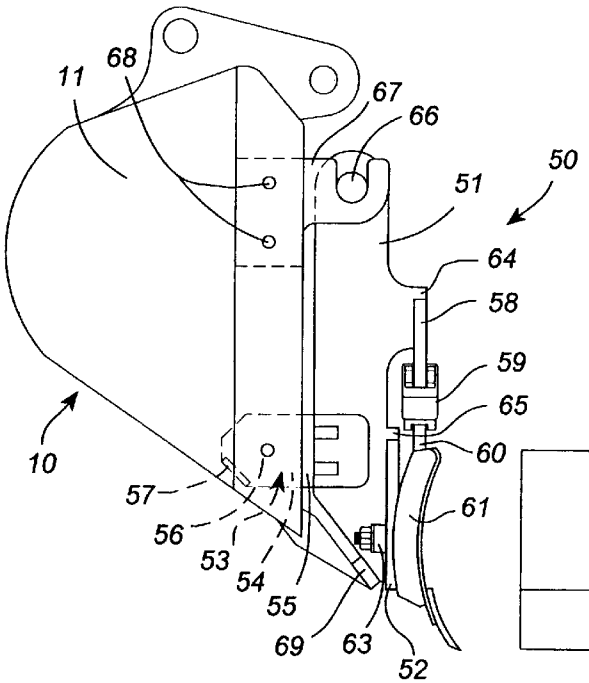
FIG. 4 Side view of an alternative embodiment fixed frame implement adapter attached to bucket brackets with a hydraulically tilting blade.

FIGS. 4–5. Description of Fixed Frame Implement Adapter for Attachment to Bucket Mounted Brackets A second embodiment of the fixed frame implement adapter connected to excavation bucket 10 depicted generally by reference number 50 as illustrated in FIGS. 4 & 5. Implement adapter 50 is provided with a frame comprising two parallel frame arms 51, an implement mounting plate 52, and a lower connecting assembly 53 identical in geometry to lower connecting assembly 23 of FIGS. 1–3. The lower connected assembly 53 comprises lower connecting arms 54 connected to the outside of the frame arms 51, outwardly projecting abutment tabs 55, bucket connecting holes 56, and a spanner 57 traversing between each distil end of the lower connecting arms 54.

Fixed frame implement adapter 50 further comprises a reinforcing plate 58 which functions in a first capacity as a mounting bracket for a hydraulic actuator 59. Hydraulic actuator 59 is connected to a hydraulic mounting connection 60 on an implement 61 rotatably connected to the implement mounting plate 52 in like manner to the implement adapter 20 in FIGS. 1–3 via an implement mounting hole 62 (FIG. 5) and a fastener assembly 63 (FIG. 4). Reinforcing plate 58 additionally operates in a second capacity to limit any relative movement of the frame arms 51 with respect to each other due to any torsional stress on the implement adapter 50 generated by implement 61 under normal working conditions.

Each frame arm 51 further comprises a quick assembly feature of an upper alignment stops 64 and a lower alignment stops 65. These stops provide a self-aligning feature to save time and improve dimensional accuracy during assembly by implement mounting plate 52 abutting against the lower alignment stops 65, and reinforcing plate 58 abutting against upper alignment stops 64. These features allow for pre-fabricated parts to be quickly and easily aligned and fastened together during assembly.

Fixed frame implement adapter 50 further comprises a coupling rod 66 fixably connected between the upper ends of frame arms 51. Each distal end of coupling rod 66 projects a distance beyond the outer surface of each frame arm 51 as shown in FIG. 5. implement adapter 50 is coupled to bucket 10 with the coupling rod 66 engaging bucket brackets 67 mounted on the inside edges of the excavation bucket 10. Bucket brackets 67 are removeably fastened by bucket mounting holes 68 through which appropriate fasteners (not shown) are applied to secure the bucket brackets 67 to bucket 10.

The attachment of implement adapter 50 to the excavation bucket 10 differs from FIGS. 1–3 in that the first step of attachment is with the distil ends of the coupling rod 66 engaging the open portions of the bucket brackets 67. Once the coupling rod 66 is rotatably engaged with the bucket brackets 67, the lower portion of the implement adapter 50 swings angularly toward the lower edge of bucket such that the lower connecting assembly 53 contacts the forward edge of the bucket sides 11 with abutment tabs 54. Appropriate fasteners are then inserted through bucket connecting holes 56 into aligned and slightly oversized holes in the lower connecting assembly arms 54 in like manner to the invention of FIGS. 1–3.

Implement adapter 50 additionally has an attached pressure plate 69 mounted to each lowermost portion of the implement adapter frame arms 51. In a similar manner to implement adapter 20 of FIGS. 1–3, upon loading of implement 61, abutment tabs 55 move into engagement with the forward edge of bucket side edges 11. Upon a further increase in the transferred loading force generated by the implement 61, the pressure plate 69 engages the lower cutting edge 12 of the excavation bucket 10 at teeth 13. In this loading situation, the implement adapter 50 is restrained from moving in a forward direction from the coupling rod 66 and the bucket brackets 67 due to the fulcrum point of the abutment tabs 55 on the front edge of the bucket side edges 11, while a majority of the force generated by the implement 61 is transferred via the pressure plate 69 through teeth 13 to the lower cutting edge 12.

Implement adapter 50 additionally differs from the invention of FIGS. 1–3 in that the center line of implement 61, aligned with the longitudinal axis of fastener assembly 63, is above the lowermost portion of teeth 13 and intersects the lowermost cutting edge 12. This provides a smaller overall dimension of the implement adapter for ease of use and maneuverability of the implement when in operation, and directly aligns the lateral force generated by the operating implement 61 through pressure plate 69 to the lower cutting edge 12, thus lessening the torsional stress acting upon the implement mounting plate 52.

Figure 7:
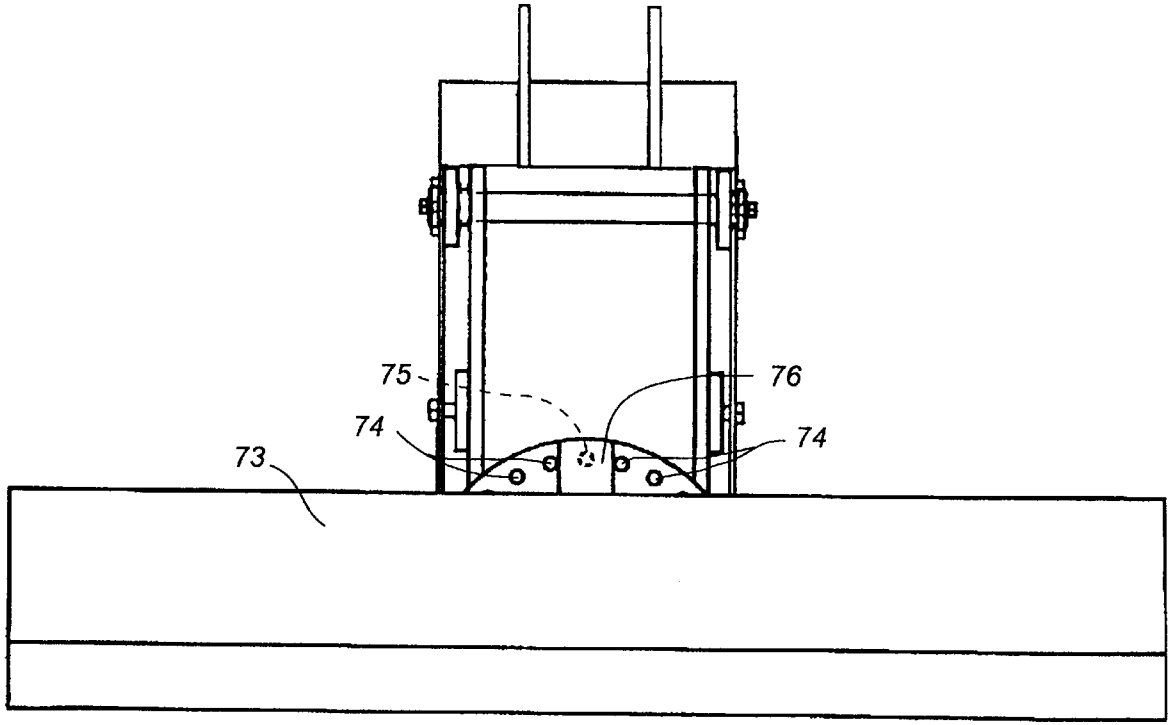
FIG. 7 Front view of an alternative embodiment fixed frame implement adapter attached to bucket brackets with a manually indexed tilting blade.
Figure 6:
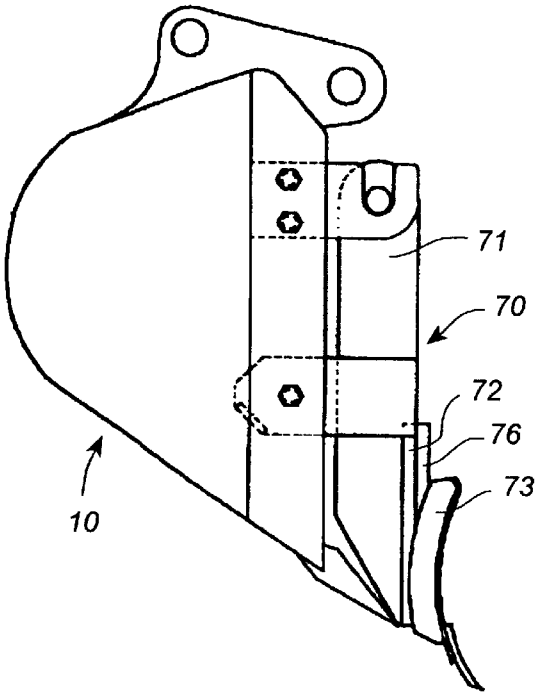
FIG. 6 Side view of an alternative embodiment fixed frame implement adapter attached to bucket brackets with a manually indexed tilting blade.

FIGS. 6–7. Description of a Fixed Frame Implement Adapter with Manually Indexed Tilting Blade FIGS. 6 & 7 illustrate an alternative embodiment for an implement adapter 70 connected to an excavation bucket 10 with similar frame geometry to implement adapter 20 of FIGS. 1–3, but with a bucket bracket mounting configuration similar to implement adapter 50 of FIGS. 4 & 5. Implement adapter 70 replaces the hydraulic tilting system of FIGS. 1–5 with a manual-indexing configuration.

The frame of implement adapter 70 comprises frame arms 71 to which is attached an implement mounted plate 72. An implement 73 is rotationally attached to a lower central portion of implement mounting plate 72 in a manner similar to the implement adapters 20 & 50 of FIGS. 1–5. Implement mounting plate 72 has a plurality of angularly spaced detents 74 a distance from the rotational axis of the implement 73 for engagement with a rearward projecting tab 75 (FIG. 7) on an index arm 76 mounted to the rear of implement 73.

Thus, if an excavation tool fails to have means for auxiliary hydraulic actuation, an operator is able to manually rotate implement 73 by disengaging projecting tab 75 of index arm 76 out of a first detent 74 position, and rotate the implement 73 and the index arm 76 such that projecting tab 75 engages another angularly displaced detent 74 position.

Figures 8A, 8B, 8C, 8D:
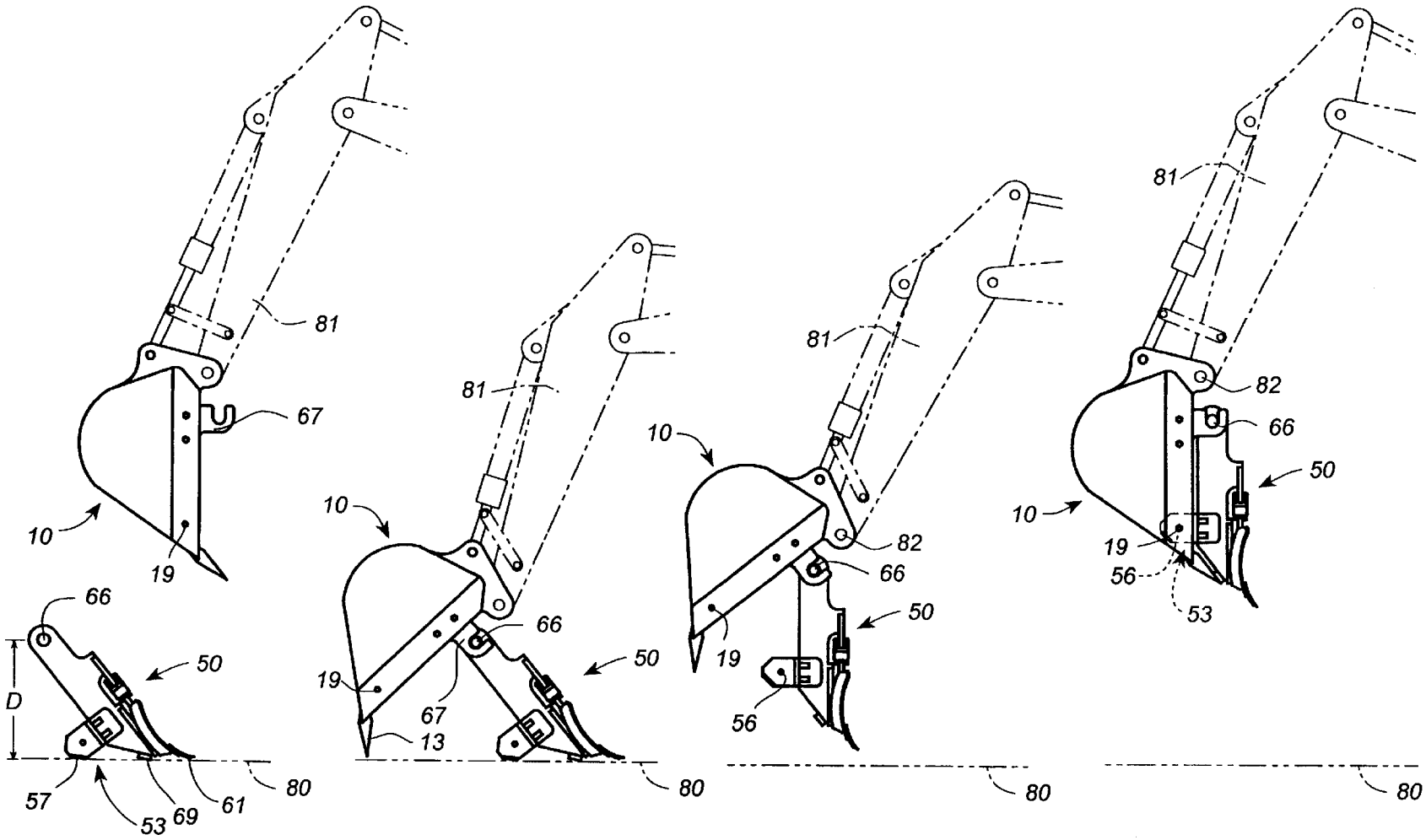
FIG. 8A Side view of the first attachment sequence step wherein the adapter is resting on ground.
FIG. 8B Side view of the second attachment sequence step wherein the bucket coupling mechanism is engaged with the upper coupling portion of the implement adapter.
FIG. 8C Side view of the third attachment sequence step wherein the implement adapter is lifted off the ground while pivotally coupled to the bucket.
FIG. 8D Side view of the fourth and final sequence step where the lower portion of the implement adapter is positioned to be securely attached to the excavation bucket.

FIGS. 8A–8D. Description of Attachment Sequence of an Implement Adapter to an Excavation Tool Assembly Without Manual Assistance FIGS. 8A–D illustrate the attachment sequence of fixed frame implement adapter 50 of FIGS. 4 & 5 to the excavation bucket 10. FIG. 8A illustrates implement adapter 50 resting on a horizontal surface 80 supported generally by the lower connection assembly 53, pressure plate 69 and the lowermost rearward portion of implement 61. Spanner 57 extends between the distal end of both sides of the lower connection assembly 53 in the form of a bar (in the same configuration as spanner 27 in FIGS. 1–3) and supports the frame of implement adapter 50 at a predetermined angle with respect to surface 80. This enables the coupling rod 66 to be parked at a certain height D above the surface 80 when the implement adapter 50 rests on the surface 80. Excavation bucket 10 is prepared for engagement to the implement adapter 50 with the coupling bucket brackets 67 mounted to the front side edges of the bucket 10. Once the excavation bucket 10 is pivotally connected to the excavation boom arm 81, the excavation bucket brackets 67 can be aligned with respect to the coupling rod 66 of the implement adapter 50.

FIG. 8B illustrates the rearwardly tilting position of the excavation bucket 10 as lowered by the boom arm 81 at the moment of coupling engagement between the bucket brackets 67 and the coupling rod 66. The height D, which coupling rod 66 is parked above the surface 80, allows the boom arm 81 to manipulate the excavation bucket 10 and its attached bucked brackets 67 into engagement with coupling rod 66 without the teeth 13 or any other portion of the forward lowermost portion of the excavation bucket 10 interfering with the surface 80.

Once coupling rod 66 is rotatably secured within the corresponding bucket brackets 67, excavator boom arm 81 is raised upward causing implement adapter 50 to rotate simultaneously about the axis of coupling rod 66 and about a longitudinal axis created by the lowermost portion of implement adapter 50 bearing along the surface 80. After excavator boom arm 81 has raised implement adapter 50 completely off the surface 80, (FIG. 8C), the hydraulic actuators of the boom arm 81 rotate the excavation bucket 10 around the wrist pin 82 to move the forward open edge of excavation bucket 10 toward the implement adapter 50.

In this manner, the implement adapter 50 is initially coupled to the excavation bucket 10 without the need for any manual assistance. Additionally, this manner of attachment provides for a quick and simple means for moving the implement adapter 50 without manual assistance, e.g., from a transportable storage position to a temporary accessible position in the work field.

For fully secured attachment of the implement adapter 50 to excavation bucket 10, the excavation bucket 10 is rotated about wrist pin 82 to such a position where the lower connection assembly 53 engages the front side edge surface of excavation bucket 10, (FIG. 8D). At this position, fasteners can be manually or automatically engaged through side connecting holes 19 of the excavation bucket 10 for releaseable attachment to the bucket connecting holes 56 of lower connection assembly 53 of the implement adapter 50, thus fully securing implement adapter 50 to the excavation bucket 10.

Figure 9:
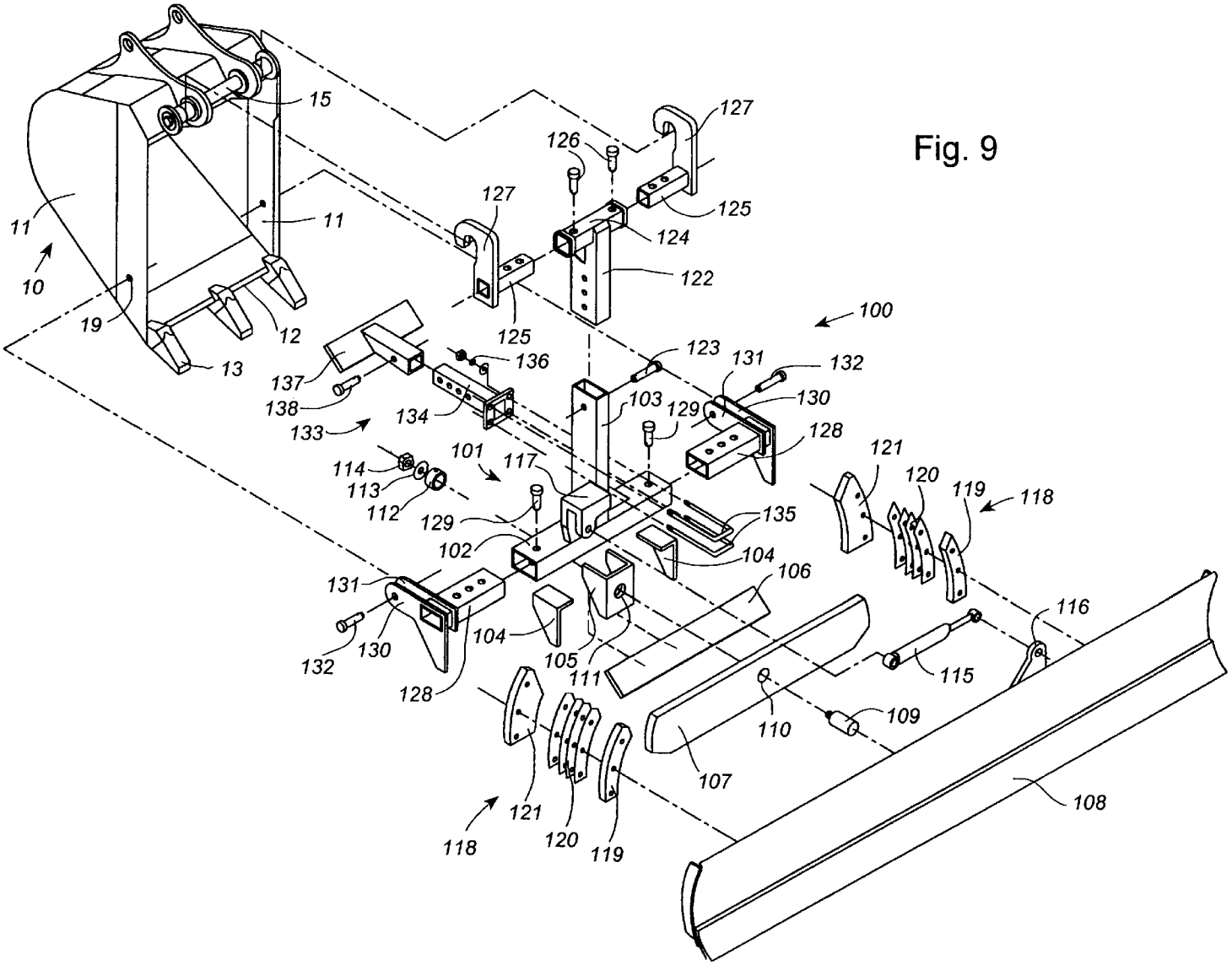
FIG. 9 Perspective exploded view of an adjustable frame implement adapter for attachment to a bucket wrist pin with a hydraulically tilting blade.
Figure 10:
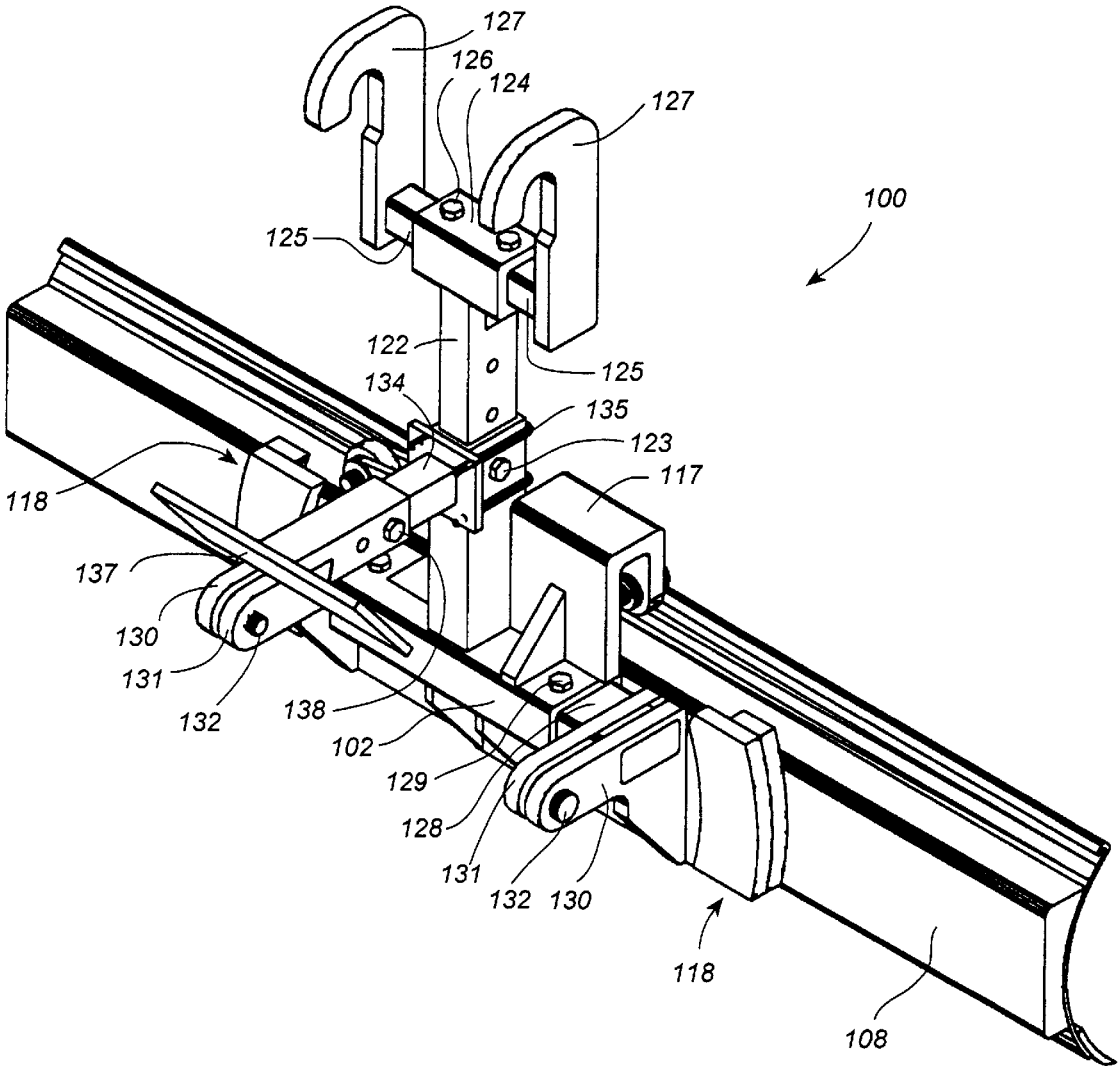
FIG. 10 Rear perspective view of an adjustable frame implement adapter with a hydraulically tilting blade.

FIGS. 9–10. Description of an Adjustable Frame Implement Adapter for Attachment to a Bucket Wrist Pin The remaining figures illustrate an adjustable frame adapter which allows a single implement adapter to be used on more than one differently dimensioned excavation tool, and enables the manufacture of a single universal adjustable implement adapter that can be adjusted to fix a wide range of sizes of excavation tools with the option of permanently affixing the adjustable frame once it has been sized for a particular excavation tool.

The adjustable implement adapter 100 of FIGS. 9 & 10 comprises an adjustable frame 101 having a horizontal frame member 102 spanning a longitudinal distance in an axis parallel to the axis of the excavation bucket 10 lower cutting edge 12. A vertical frame member 103 is connected to an upper midpoint of horizontal frame member 102 and extends upward in a longitudinal direction. Attached to the lower surface of horizontal frame member 102 are end brackets 104 mounted at both distal ends of the horizontal frame member 102, and a center bracket 105 mounted at the center of the horizontal frame member 102. Both end brackets 104 and center bracket 105 have rearwardly and downwardly angled mounting edges planarly aligned to receive and fixedly mount a planar surface of a pressure plate 106 thereto. Additionally, end brackets 104 and center bracket 105 have forwardly facing vertical edges and coplanarly aligned surfaces to receive and fixedly mount the planar surface of an implement mounting plate 107 thereto.

A blade-type implement 108 is rotationally attached to the central portion of the implement mounting plate 107 by means of a stud 109 fixedly attached to the back of implement 108 for passage through an implement mounting plate hole 110 in the center portion of the implement mounting plate 107 and a center bracket hole 111 into a collar 112 fixedly attached to a rearwardly facing surface of the center bracket 105. A threaded end portion of stud 109 projects rearwardly past collar 112 for engagement with a washer 113 and nut 114 for rotationally securing implement 108 relative to the forward surface of implement mounting plate 107.

Implement 108 is able to be rotated with a hydraulic actuating component 115 coupled to a hydraulic implement connection 116 mounted on the implement 108 a longitudinal distance away from the rotational axis of the stud 109, and to a hydraulic frame connection 117. Through standard means of hydraulic actuation, implement 108 is able to be rotated around the rotational axis of the stud 109 while mounted on the implement mounting plate 107 of the fixed frame implement adapter 100.

The implement 108 additionally has two wear plate assemblies 118 attached to the rearward surface of the implement 108 for engagement with longitudinal distil end portions of the implement mounting plate 107. The wear plate assemblies 118 comprises a front wear plate 119 having a forward edge contacting the rearward surface of implement 108, a series of wear plate shims 120 contacting the rearward surface of the front wear plate 119, and a rear wear plate 121 contacting the rearward surface of the rearmost wear plate shim 120. When the wear plate assembly is fastened together and fixed to the rear of implement 108, the inside forward surface of the rear wear plate 121 contacts the rearward facing longitudinally distal end surface of the implement mounting plate 107.

There are two instances when operation of the implement 108 would generated a forward force on the implement causing the implement to separate from the implement mounting plate 107. The first is when the implement 108 is moved against material in a rearward direction, commonly called back-blading, where the implement is dragged rearwardly against working material. The second occurs while the implement 108 moves in a forward direction and only one of the longitudinal edges of the implement 108 catches on working material creating a torsional stress on the opposite edge of implement 108 causing it to move away from the implement mounting plate 107. The wear plate assemblies 118 contacting the implement mounting plate 107 retain the implement from movement in a forward direction thus providing reduced stress upon the stud 109 connection of the implement mounting plate 107 and the implement 108.

An upper vertical frame member 122 is slidingly received by the uppermost portion of vertical frame member 103. A hole in vertical frame member 103 allows for a semi-fixed attachment to the upper vertical frame member 122 with a vertical frame member pin 123 attached at one of a plurality of lengths determined by a plurality of spaced holes on the upper vertical frame member 122. At the uppermost longitudinal end of upper vertical frame member 122 is a coupling frame member 124 which projects in two directions outwardly and orthogonal to the upper vertical frame member 122. Outer coupling frame members 125 are slidingly received by the coupling frame member 124. A hole at each distal end of the coupling frame member 124 allows for semi-fixed attachment to the outer coupling frame members 125 with coupling frame pins 126 attached at one of a plurality of lengths determined by a plurality of spaced holes on the outer coupling frame members 125. At each distil end of the outer coupling frame members is a coupling yoke 127 with a semi-circular opening sized to be rotationally coupled with the excavation bucket wrist pin 15.

Outer horizontal frame members 128 are slidingly received by the outer portions of the horizontal frame member 102. A hole in the horizontal frame member 102 allows for the semi-fixed attachment to the outer horizontal frame member 128 with horizontal frame member pins 129 attached at one of a plurality of lengths determined by a plurality of spaced holes on the outer horizontal frame members 128. At each distil end of the outer horizontal frame member is an outer guide plate 130 and a parallel inward spaced inner guide plate 131. The forward edge of the outer guide plate 130 fixedly attaches to implement mounting plate 107 to improve the rigidity of the implement adapter 100 during operation of the implement. Each guide plate has openings to receive a guide plate fastener 132 therethrough. When each respective forward side edge 11 of the excavation bucket 10 is brought between the outer guide plate 130 and the inner guide plate 131, whereby the attachment holes 19 align with the guide plate openings, the guide plate fasteners 132 can then be inserted manually or automatically, as previously disclosed, through the holes in the outer guide plate 130, the excavation bucket attachment holes 19, and finally the inner guide plate 131.

Parking foot assembly 133 is mounted midway on the vertical frame member 103 by means of a parking frame 134 extending rearwardly and fastened to the vertical frame member 103 with U-bolts 135 and fastening hardware 136. A parking foot 137 slidingly receives the rearmost distal end of the parking frame 134. A hole in parking foot 137 allows for semi-fixed attachment to the parking frame 134 with a parking foot pin 138 attached at one of a plurality of lengths determined by a plurality of spaced holes on parking frame 134. Parking foot assembly 133 is adjusted such that when the adjustable implement adapter 100 is separated from the excavation bucket and rests on a horizontal surface contacting the end portion of the parking foot 137 and either the pressure plate 106 or the implement 108, the coupling yoke 127 will be a sufficient distance from the surface for the coupling wrist pin 15 of an excavation bucket 10 to engage the coupling yoke 127 of the adjustable implement adapter without the need for manual assistance.

An alternative embodiment achieving the same parking function of the parking foot assembly 133, provides a rigid spanner bar between the inside portions of the inner guide plates 131 in a manner similar to spanner 27 of FIG. 1.

To attach the adjustable implement adapter 100 to the excavation bucket 10, the outer coupling frame members 125 are adjusted and fastened with respect to coupling frame member 124 such that the distance between the coupling yokes 127 is the same distance between the coupling surface portions on wrist pin 15. The upper vertical member 122 is adjusted and fastened with respect to the vertical frame member 103 such that fastening holes of the inner 131 and outer guide plates 130 are on the same horizontal plane upon alignment when the coupling yokes 127 are attached to the wrist pin 15. Next, the outer horizontal frame members 128 are adjusted and fastened with respect to the horizontal frame member 102 such that the inner 131 and outer guide plates 130 will receive the forward side edges 11 of the excavation bucket 10 when the adjustable implement adapter is pivotally swung into contact with the excavation bucket 10.

A rearward facing surface of the outer horizontal frame member between each inner 131 and outer guide plates 130 acts as an abutment stop to properly align the slightly oversized openings of the inner 131 and outer guide plates 130 with the attachment holes 19 of the excavation bucket 10, and to be the first load bearing contact with the bucket when the implement 108 generates loading during operation. As additional force is transferred by the implement 108 to the excavation bucket 10, the adjustable implement adapter 100 is restrained from moving in a forward direction at the coupling of the bucket wrist pin 15 and the coupling yokes 127 due to the fulcrum point of the rearward surface of the outer horizontal frame member 128 on the front edge of the bucket side edges 11. A majority of the force generated by the implement 108 is then transferred via the pressure plate 106 through teeth 13 to the lower cutting edge 12.

Figure 11:
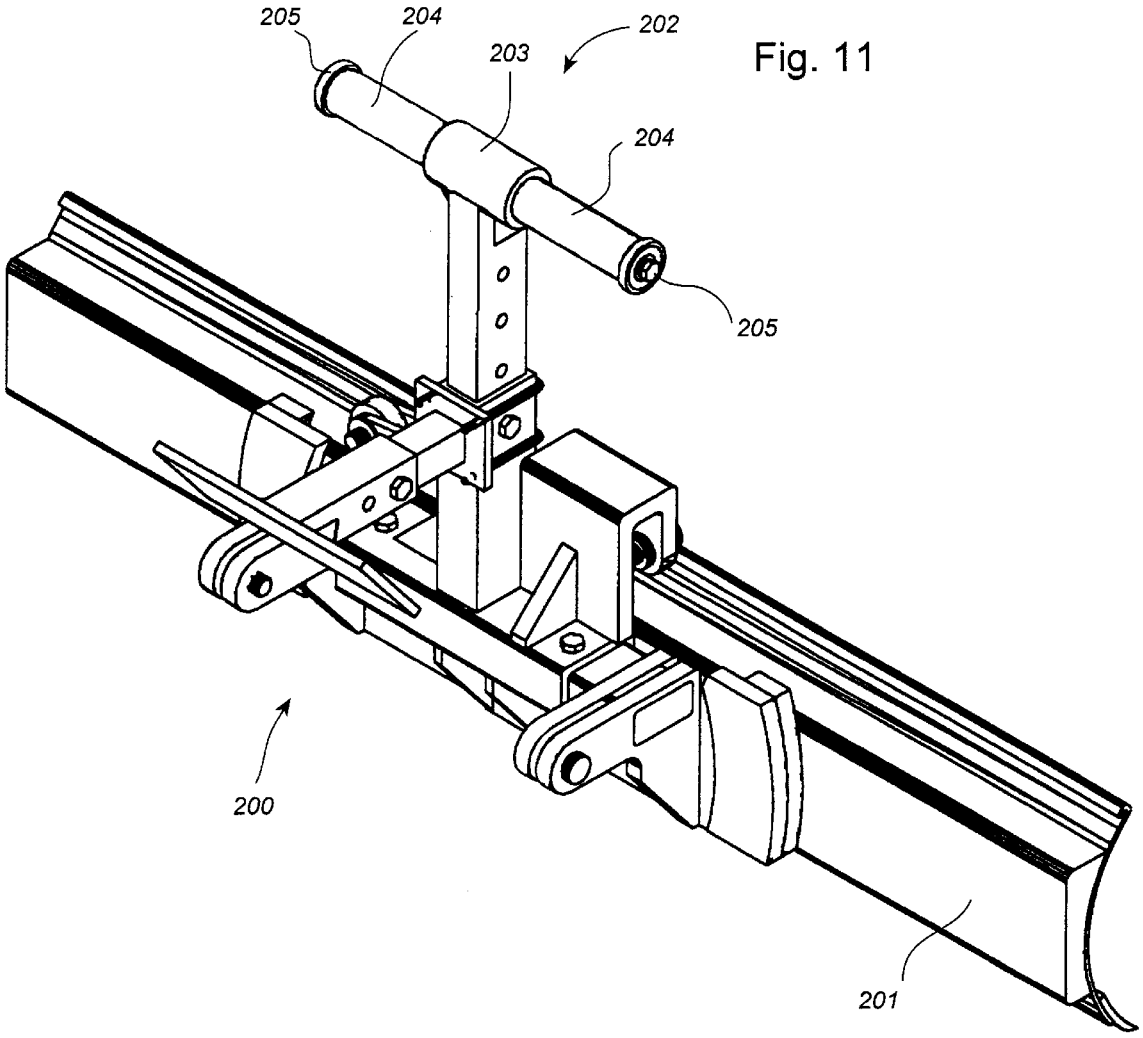
FIG. 11 Rear perspective view of an adjustable frame implement adapter with a hydraulically tilting blade with an alternative upper coupling embodiment for attachment to bucket brackets.

FIG. 11. Description of an Alternative Embodiment of the Adjustable Frame Adapter for Attachment to Bucket Brackets Adjustable implement adapter 200 and implement 201 of FIG. 11 is identical in structure to the adjustable implement adapter 100 of FIGS. 9 & 10, except the coupling frame member 124 and corresponding outer coupling frame 125 and coupling yoke 127 (see, FIGS. 9 & 10) have been replaced with an adjustable length T-rod assembly 202 comprising a rod mount 203 and a coupling T-rod 204 projected outwardly and away from the rod mount 203. At each distal end portion of the coupling T-rod 204 is a rod stop 205. T-rod assembly 202 mounts to the excavation bucket 10 in the same manner as illustrated by FIGS. 4–7, i.e., by coupling the T-rod 204 to the bucket brackets fixedly mounted on the inside forward edges the bucket side edges.

Depending on the length of the coupling T-rod 204, the adjustable implement adapter 200 can be used in conjunction with the bucked mounted brackets on any excavation tool where the width between the side edges of the bucket is less than or equal to the length of the coupling T-rod 204. Coupling T-rod 204 provides for a continuously adjustable bearing surface along the longitudinal axis of the rod to receive the corresponding journal surfaces of the bucket brackets.

Figure 13:
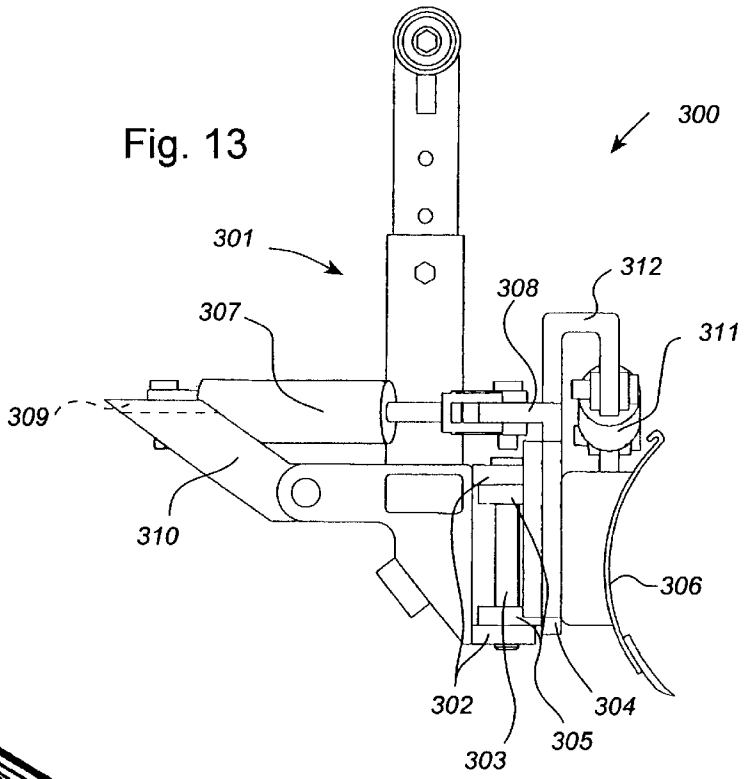
FIG. 13 Side view of an adjustable frame implement adapter with a hydraulically tiling and skewing blade.
Figure 12:
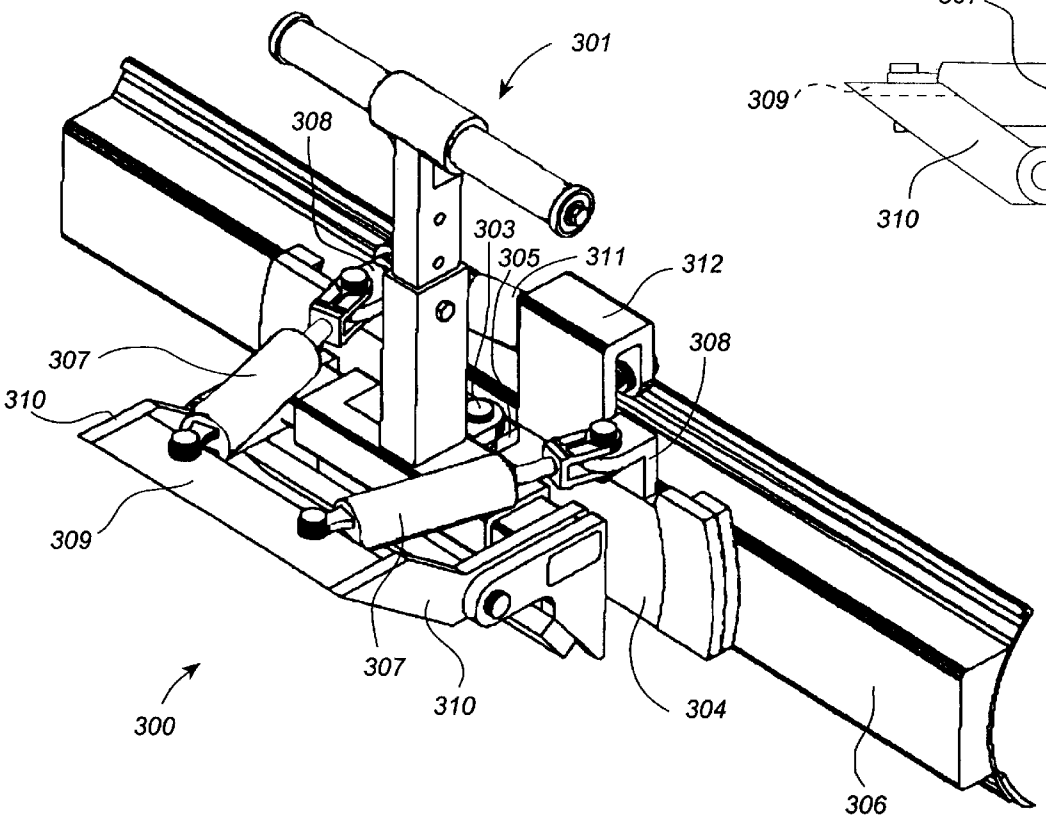
FIG. 12 Rear perspective view of an adjustable frame implement adapter with a hydraulically tiling and skewing blade.

FIGS. 12 & 13. Description of an Adjustable Frame Implement Adapter with a Hydraulically Rotating and Skewing Blade Implement Implement adapter 300 of FIGS. 12 & 13 illustrate an alternative embodiment to that of implement adapter 200 of FIG. 11 which allows the implement to be skewed, or rotated about a vertical axis while mounted to the implement adapter. The lower portion of the adjustable frame 301 has centrally located frame hinge fittings 302 rotatably coupled by a hinge pin 303 to corresponding hinge fittings 305 on the implement mounting plate 304. The implement 306 is positioned in a forward direction away from the forward surface of the adjustable frame 301 which allows the implement 306 to be rotated around the hinge pine 303 during operation.

Skewing hydraulic actuators 307 are attached to skewing tabs 308 mounted on a top outward portion of each longitudinal end of the implement mounting plate 304. The opposite end of the skewing hydraulic actuators 307 are affixed to a parking spanner 309. Each distil end of the parking spanner 309 is attached to a rearmost upper portion of an extended inner guide plate 310. Hydraulic skewing of the implement about the vertical axis of the hinge pin 303 takes place when each hydraulic actuator 307 extends or retracts in a direction opposite the other to induce a rotational moment of the implement 306 around the axis of the hinge pin 303. Additionally, as described previously in the invention of FIGS. 1–5 & 9-11, implement 306 can be rotated around a horizontal axis in the forward direction by means of another hydraulic actuator 311 mounted between an implement mounted bracket and an implement mounting plate bracket 312. Thus, implement adapter 300 is enabled to rotatably articulate the implement 306 along two axes orthogonal to each other giving the operator control over an additional range of motion for the implement.

The extended inner guide plate 310 in combination with the parking spanner 309 functionally serves a rigid attachment point for the skewing hydraulic actuators 307, and additionally serves as a parking support for the adjustable implement adapter 300. This parking support allows a top coupling portion of the frame 301 to remain a distance above a surface the implement adapter rests upon when detached from an excavation tool. The distance the top coupling portion of the frame 301 maintains with the resting surface of the implement adapter 300 allows for an excavation tool to engage and disengage the implement adapter 300 without the need for any manual assistance.

Parking spanner 309 can also be configured to adjust in length relative to the adjustable width feature of the horizontal frame member of frame 301. In this configuration, parking spanner 309 comprises a central fixed length member that mount each of the rearward ends of the skewing hydraulic actuators 307 and separate members having a plurality of attachment points fastened to each end of the central fixed length member and the upper distal ends of the extended inner guide plates 310. This adjustable configuration provides for fixed points of attachment for the skewing hydraulic actuators 307 while still allowing the implement adapter 300 to mount on excavation tools of various widths.

In summary, the configuration of the sparking spanner 309 in combination with the inner guide plate extension 310 provides a three-fold purpose for implement adapter 300: a locating guide for attachment of the implement adapter 300 to an excavation tool; a parking foot that orients the geometry of the implement adapter 300 for non-assisted attachment to an excavation tool; and a fixed point of attachment for actuators 307 that enable an implement 306 to be rotated about a vertical axis.

Where hydraulic actuation is unavailable to skew implement 108, an alternative embodiment of implement adapter 300 would replace hydraulic actuators 307 with a rigid fastening element able to be manually fastened to skewing tabs 308 and the parking spanner 309 along a plurality of fastening positions. Thus, an operator is able to manually skew and angularly affix the implement 108 by changing the fastening positions of the rigid element while connected to the skewing tabs 308 and the parking spanner 309.

Figure 15:
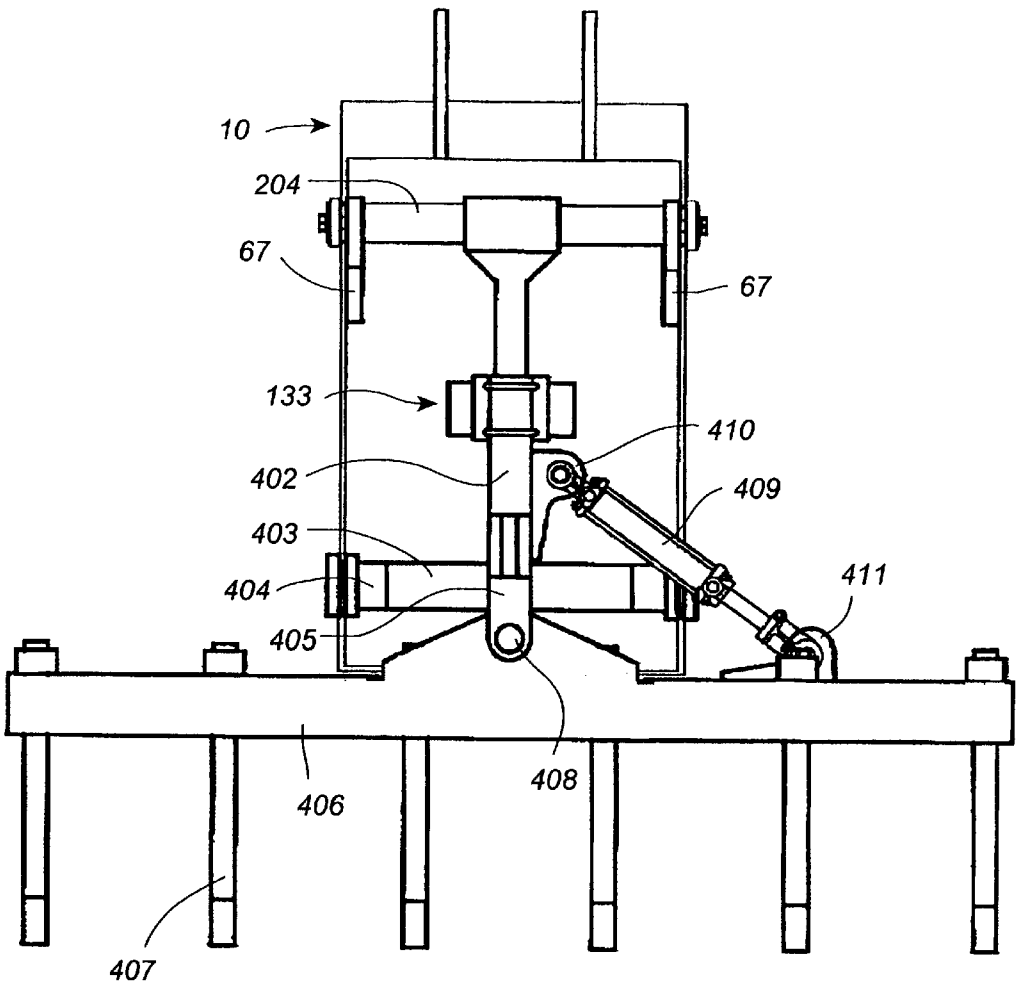
FIG. 15 Front view of adjustable frame implement adapter attached to excavation tool brackets with a hydraulically tilting scarifying rake.
Figure 14:
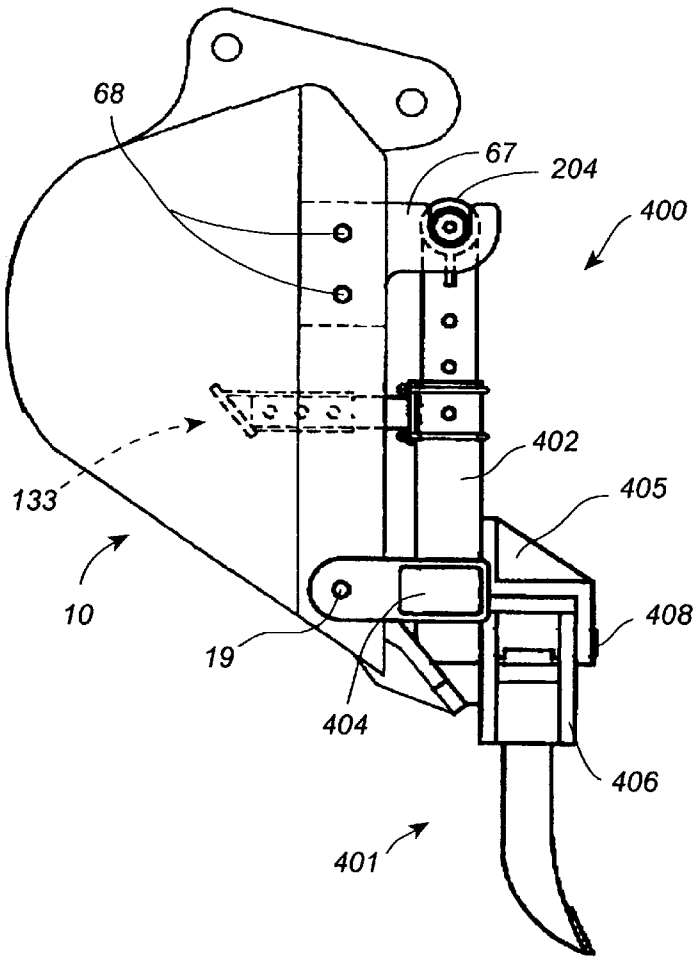
FIG. 14 Side view of an adjustable frame implement adapter attached to excavation tool brackets with a hydraulically tilting scarifying rake.

FIGS. 14 & 15. Description of an Adjustable Frame Implement Adapter with a Hydraulically Tilting Scarifying Rake Implement FIGS. 14 & 15 illustrate an adjustable frame implement adapter 400 similar to the bucket bracket mounted adjustable implement adapter 200 of FIG. 11, except that the blade-type implement has been replaced with a hydraulically tilting scarifying rake assembly 401. Adjustable frame implement adapter 400 is coupled via the coupling T-rod 204 to the excavation bucket 10 with the bucket brackets 67 attached at the bucket mounting holes 68. Vertical frame member 402 connects the T-rod 204 to the adjustable horizontal frame member 403 whose outer horizontal frame members 404 connect to a lower forward portion of the excavation bucket 10 at the attachment holes 19. Parking foot assembly 133 is connected to and extends rearwardly into the excavation bucket 10 opening from a middle portion of the vertical frame member 402.

The scarifying rake assembly 401 is attached to the lower portion of the vertical frame member 402 that extends below the horizontal frame member 403. A first portion of an implement mounting bracket 405 is attached to a forward surface of the vertical frame member 402 and a second portion extends in a forward direction a distance sufficient to hold an implement between the first and second portion. A scarifying rake implement 406 having a plurality of teeth 407 is rotatably coupled at its midpoint between the first and second portions of the implement mounting bracket 405 by a pivot pin 408. This allows for the scarifying rake implement to be rotated around the pivot pin 408 relative to the adjustable frame implement adapter 400. A hydraulic actuating mechanism 409 controls the rotational movement of the scarifying rake implement 406 by attachment to a frame bracket 410 on the vertical frame member 402 and to an implement bracket 411 located on a portion of the scarifying rake implement 406 between its distil longitudinal end and the pivot pin 408.

Figure 17:
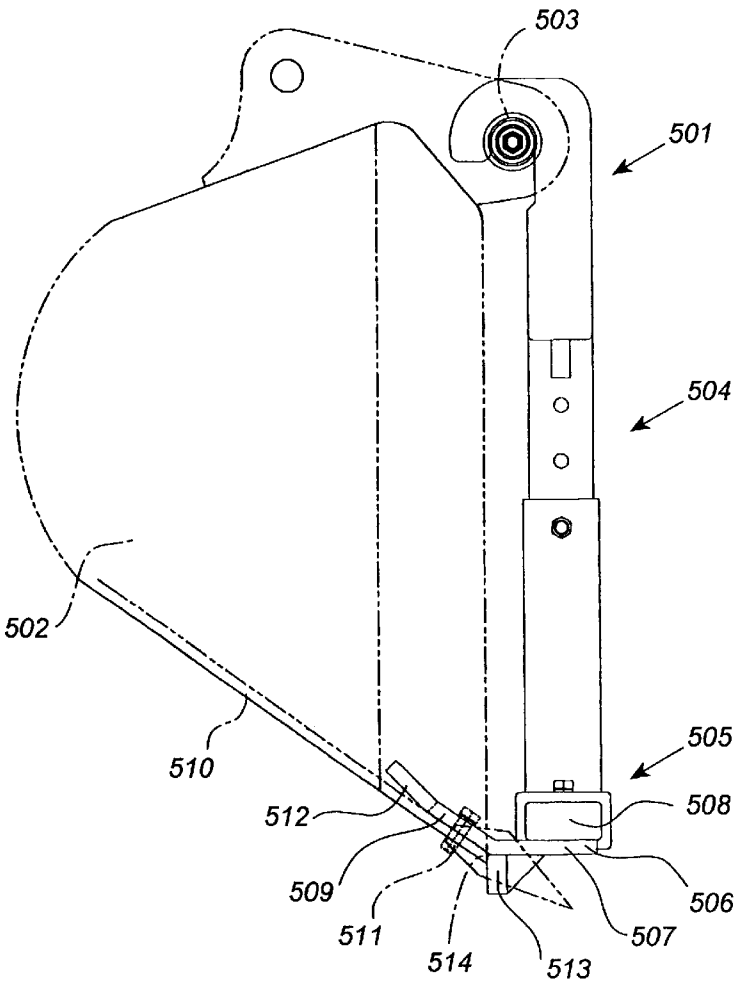
FIG. 17 Side view of an alternative embodiment of a frame for an adjustable implement adapter for connection to the excavation tool's cutting edge.
Figure 16:
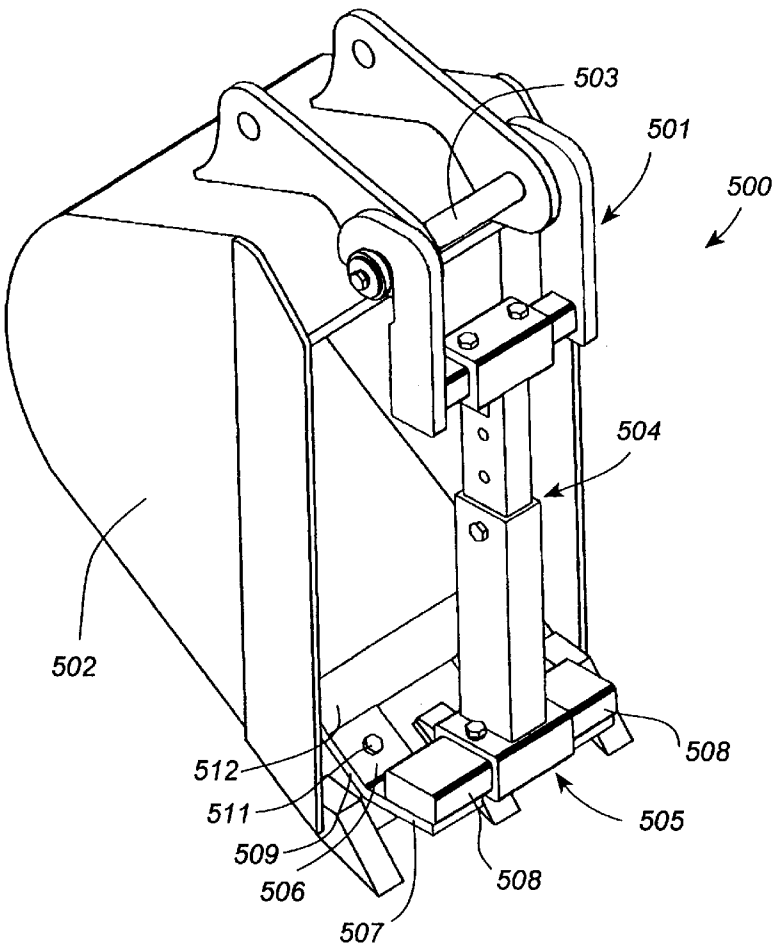
FIG. 16 Perspective view of an alternative embodiment of a frame for an adjustable implement adapter for connection to a lower portion of the excavation tool cutting edge.

FIGS. 16 & 17. Description of an Alternative Embodiment of an Adjustable Frame Implement Adapter for Connection to a Lower Portion of an Excavation Bucket Cutting Edge An alternative embodiment of the adjustable frame implement adapter of FIGS. 9–15 is an adjustable frame implement adapter 500 mounted on a lower cutting edge of an excavation bucket. FIGS. 16 & 17 show an upper coupling assembly 501 coupled to an excavation bucket 502 wrist pin 503 (similar to the invention of FIGS. 9 & 10), an adjustable vertical frame member 504 (similar to the invention of FIGS. 9–15), and an adjustable horizontal frame member 505 (similar to the invention of FIGS. 9–15). The adjustable frame implement adapter 500 receives an implement mounted plate for mounting a working implement (not shown) on the forward lower surface of the adjustable vertical frame member 504 and the forward surface of the adjustable horizontal frame member 505 in a similar manner to the invention disclosed in FIGS. 9–11.

A rearwardly projecting mounting foot 506 is attached at a first portion 507 to the lower surfaces of each outer adjustable horizontal frame member 508. The mounting foot 506 has a second portion 509 projecting rearwardly from the first portion 507 at an angle relative to the first portion 507 which allows the second portion 509 to lie flush upon the inner lower surface 510 of the excavation bucket 502. The adjustable frame implement adapter 500 is connected to the excavation bucket by each second portion 509 of the mounting foot 506 having an slightly oversized attachment hole through which a fastener 511 is inserted for receipt in an aligned hole in the lower cutting surface 510 of the excavation bucket 502.

A third portion 512 of the mounting foot 506 projects rearwardly from the second portion 509 at an angle of approximately fifteen degrees relative to the second portion 509 and the inner lower surface 510 of the excavation bucket 502. Additionally, the third portion 512 spans continuously between each of the second portions 509. The third portion 512 of the mounting foot 506 enables the adjustable frame implement adapter 500 to be held in a parked position for maintaining the upper coupling assembly 501 at a sufficient height above a surface when the implement adapter 500 is detached from the excavation bucket 502 and supported on the surface by the third portion 512 of the mounting foot and a lowermost portion of either the frame or the working implement. The height at which the upper coupling assembly 501 is held by the third portion 512 of the mounting foot 506 enables engagement of the upper coupling assembly 501 with the wrist pin 503 on the excavation bucket 502 without the need for any manual assistance.

An alternative embodiment of the third portion's 512 connection to the second portion 509 is by use of removable fasteners. This allows the third portion 512 to have a plurality of fastener positions with respect to a single mating fastener element on the second portion 509 thereby operating in a complementary fashion with the adjustable horizontal frame member 505.

Integrally attached to each of the lower surfaces of the first portions 507 of the mounting foot 506 are abutment tabs 513 (FIG. 19), having a vertical rearwardly facing surface for engagement with the lower forward cutting edge 514 of the excavation bucket 502. The abutment tabs 513 coupled with the oversized attachment holes in the second portions 509 of the mounting foot allow for movement of the lowermost portion of the adjustable frame implement adapter 500 relative to the forward cutting edge 514 of the bucket 502. While operating an implement mounted on the vertical 504 and horizontal 505 frame member, the implement transmitted loading moves the abutment tabs 513 into engagement with the forward cutting edge 514 of the bucket 502. This engagement arrangement transfers the load to the forward cutting edge 514 to prevent shear loading of the fasteners 511 while connecting the adjustable frame implement adapter 500 to the bucket 502.

Figure 18:
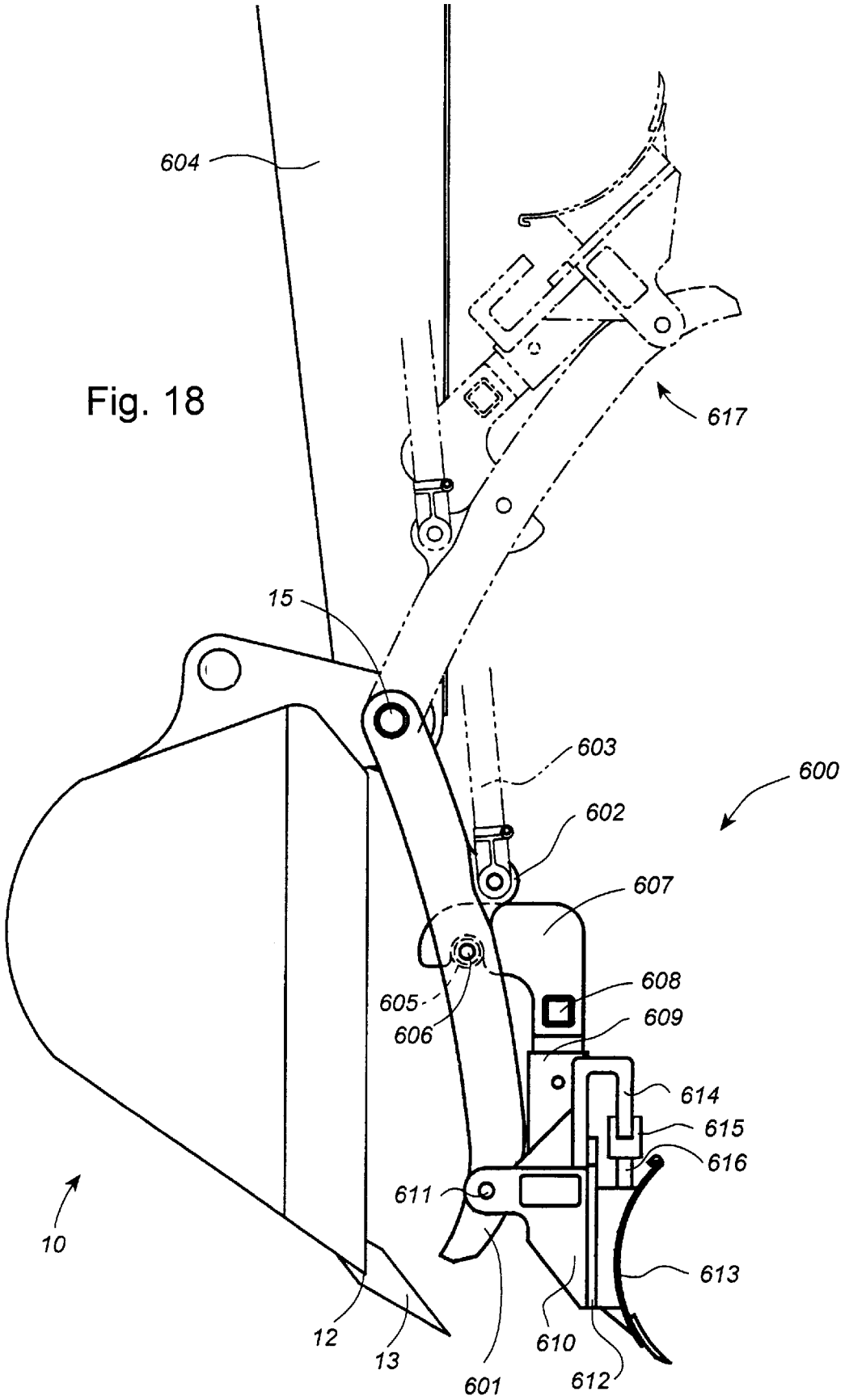
FIG. 18 Side view of adjustable frame implement adapter attached to an excavation thumb with a hydraulically tilting blade.
Figure 19:
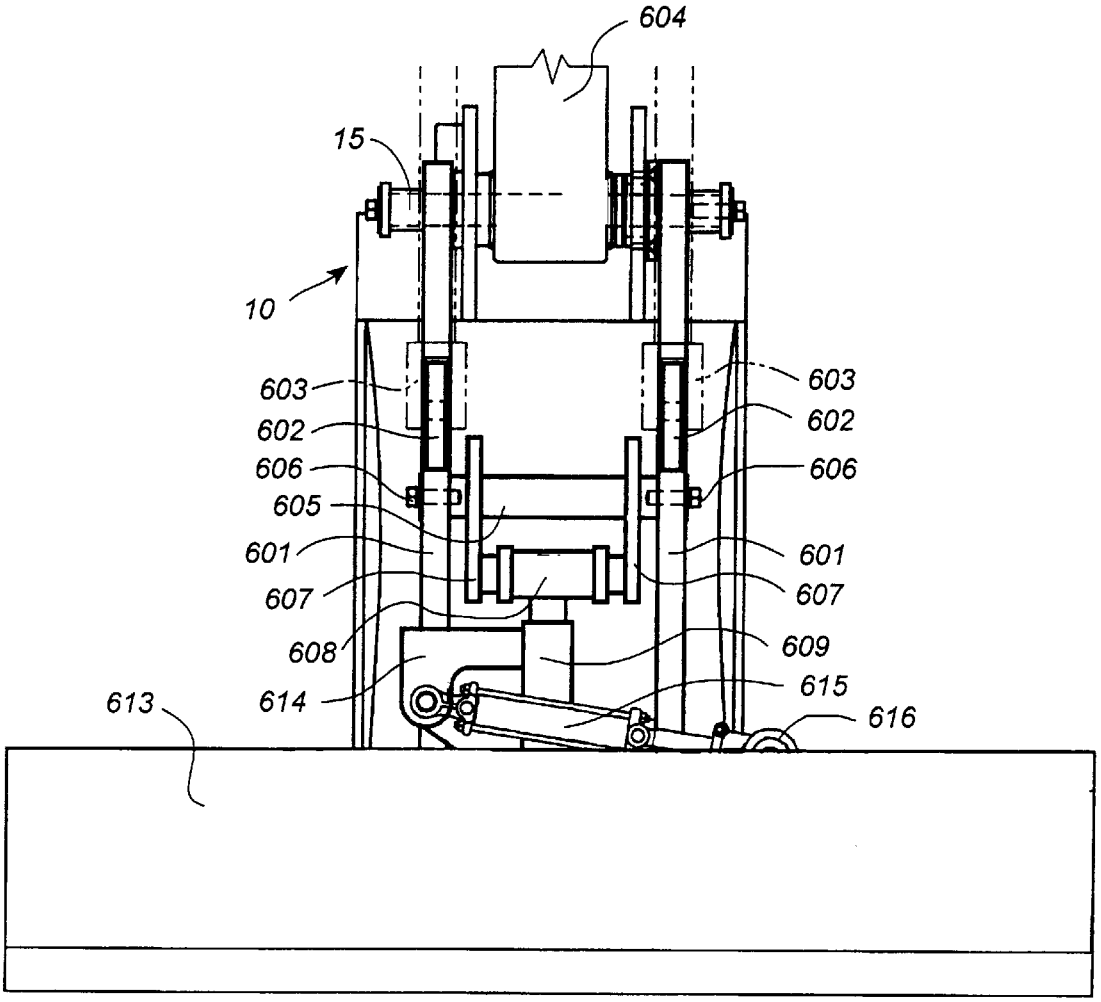
FIG. 19 Front view of adjustable frame implement adapter attached to an excavation thumb with a hydraulically tilting blade.

FIGS. 18 & 19. Description of an Excavation Thumb Mounted Adjustable Frame Implement Adapter The excavation tool assembly in FIGS. 18 & 19 include an excavation thumb mounted adjustable frame implement adapter 600 attached to an excavation thumb 601. Excavation thumb 601 comprises multiple parallel arms (see FIG. 17) each pivotally joined at a longitudinal end to distal ends of the excavation bucket wrist pin 15. Near a middle portion of each excavation thumb 601 is a flange 602 for attachment to one end of a hydraulic actuator 603. The second end of the hydraulic actuator 603 is attached (not shown) to the boom arm 604 for rotationally displacing the excavation thumb 601 into and out of engagement with the teeth 13 at the lower forward cutting edge 12 of the excavation bucket 10.

A connection rod 605 is attached by fasteners 606 at an inside middle portion of each excavation thumb 601. The connection rod 605 is coupled to a pair of coupling yokes 607 of the excavation thumb mounted adjustable frame implement adapter 600. Coupling yokes 607 are connected to an adjustable coupling frame member 608 which allows the distance between the coupling yokes 607 to be adjusted for different sized connection rods 605, as similarly described in the invention of FIGS. 9 & 10. The adjustable coupling frame member 608 is connected to an adjustable frame member 609 having a lower adjustable horizontal frame members (not shown) similar to the invention disclosed in FIGS. 9–15 each having a guide plate assembly 610 connected to the outer distal ends of the lower adjustable horizontal frame member (in a similar manner to FIGS. 9–15). Each guide plate assembly 610 is connected to a lower portion of the excavation thumb via a fastener coupled through a connection hole 611 in the guide plate assembly 610 into a corresponding receptacle in the lower portion of the excavation thumb 601.

An implement mounting plate 612 is attached to a lower portion of the vertical frame member 609 and the lower adjustable horizontal frame member for rotatably mounting an implement 613. One end of a hydraulic actuator 615 is attached to a frame connection plate 614 fixed to both the horizontal and the vertical frame member 609, and the other end to an implement mounting bracket 616 on the implement 613. Hydraulic actuator 615 enables rotational displacement of the implement 613 around a centrally located rotational attachment to the excavation thumb mounted adjustable frame implement adapter 600 similar to the invention disclosed in FIGS. 1–5 & 8–11.

The advantages of an excavation thumb mounted implement adapter on a excavation tool assembly enables the initial coupling of the implement adapter 600 to the excavation thumb without manual assistance when the implement adapter rests on a surface supported by the guide plate assembly 610 and the lower portion of either the adapter frame or the implement. The mounting arrangement of the implement adapter on the opposite side of the excavation thumb's engaging surface allows for the unhindered operation of the excavation thumb without interference from the mounted implement adapter and the implement. Since the implement can be quickly swung into and out of a working position with the movement of the excavation thumb, the bucket or another excavation tool can be used while the excavation thumb and implement are in a retracted position 617. This eliminates the need to remove the implement adapter from the excavation tool, in this case the excavation bucket, when the excavation tool is desired be used alone.

Additionally, alternative attachment means would replace the coupling yokes 607 of the excavation thumb mounted adjustable frame implement adapter 600 with a T-rod similar to the T-rod 204 of FIG. 11, for reception by bearing surfaces in the excavation thumb mounted brackets.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. An implement adapter for use in combination with an excavation tool, said implement adapter comprising:

frame means for holding working implements;

coupling means integral with an upper portion of said frame means adapted for coupling to cooperative coupling means on an upper portion of said excavation tool;

connecting means extending from a lower portion of said frame means adapted for connecting to a lower portion of said excavation tool;

implement mounting means immovably secured to a lower portion of said frame means adapted for mounting working implements; and parking means extending a distance from a lower portion of said frame means for orienting said coupling means to a sufficient height above a surface when said implement adapter is supported on said surface by said parking means and a lowermost portion of said frame means, wherein said sufficient height is adapted to enable engagement of said coupling means with said cooperative coupling means on said excavation tool with no manual assistance.

2. The implement adapter in accordance with claim 1, wherein said frame means further comprises two parallel spaced arms with said coupling means having a semicircular bearing surface on upper distal ends of each of said parallel spaced arms adapted for pivotal coupling with a mating circular element of said cooperative coupling means.

3. The implement adapter in accordance with claim 1, wherein said coupling means further comprises a coupling rod fixably attached to an upper end portion of said frame means adapted for pivotal coupling with at least one semicircular bearing surface on said cooperative coupling means.

4. The implement adapter in accordance with claim 1, wherein said implement mounting means further comprises:

pivot means for enabling rotational movement of said mounted working implements about an axis orthogonal to the vertical axis of said frame means.

5. The implement adapter in accordance with claim 4, wherein said implement mounting means further comprises:

manual rotational indexing means coupled between said implement mounting means and said mounted working implement for manual rotation of said working implement with respect to said implement mounting means.

6. The implement adapter in accordance with claim 4, wherein said implement mounting means further comprises:

remotely actuated rotational means coupled between said implement mounting means and said mounted working implement for remotely actuated rotation of said mounted working implement with respect to said implement mounting means.

7. The implement adapter in accordance with claim 1, further comprising:

pressure plate means fixably attached to a lower rearward portion of said frame means adapted for engagement with a digging surface of said excavation tool.

8. The implement adapter in accordance with claim 1, said implement mounting means further comprising:

a rearward facing planar surface on each longitudinal end of said implement mounting means, each said rearward facing planar surface adapted to engage a mating parallel surface of a wear plate mounted on said working implement.

9. The implement adapter in accordance with claim 1, wherein said parking means is said rearmost distal end of said connecting means.

10. The implement adapter in accordance with claim 1, wherein said parking means further comprises at least one projection with a parking foot attached thereto.

11. The implement adapter in accordance with claim 1, further comprising abutment means fixably mounted on said connecting means between said frame means and a forward edge of said excavation tool for abutment upon said forward edge.

12. An adjustable implement adapter for use in combination with an excavation tool, said adjustable implement adapter comprising:

frame means for holding working implements, said frame means adjustable in length along a vertical axis;

coupling means integral with an upper portion of said frame means adapted for coupling to cooperative coupling means on an upper portion of said excavation tool, said coupling means adjustable in length along a first horizontal axis;

connecting means extending from a lower portion of said frame means for connecting to a lower portion of said excavation tool, said connecting means adjustable in length along a second horizontal axis;

implement mounting means immovably secured to a lower portion of said frame means adapted for mounting working implements; and parking means incrementally adjustable in length along an axis orthogonal to said vertical axis, and extending a distance from said frame means for orienting said coupling means to a sufficient height above a surface when said implement adapter is supported on said surface by said parking means and a lowermost portion of said frame means, wherein said sufficient height enables engagement of said coupling means with said cooperative coupling means on said excavation tool with no manual assistance.

13. The adjustable implement adapter in accordance with claim 12, wherein said coupling means further comprises two parallel spaced arms having a semi-circular bearing surface on upper distal ends of each of said parallel spaced arms adapted for pivotal coupling with a mating circular element of said cooperative coupling means.

14. The adjustable implement adapter in accordance with claim 12, wherein said coupling means comprises coupling surfaces along a coupling rod adapted for pivotal coupling with at least one semi-circular bearing surface on said cooperative coupling means.

15. The adjustable implement adapter in accordance with claim 12, wherein said implement mounting means further comprises:

pivot means for enabling rotational movement of said mounted working implements about an axis orthogonal to the vertical axis of said frame means.

16. The adjustable implement adapter in accordance with claim 15, wherein said implement mounting means further comprises:

manual rotational indexing means coupled between said implement mounting means and said mounted working implement for manual rotation of said working implement with respect to said implement mounting means.

17. The adjustable implement adapter in accordance with claim 15, wherein said implement mounting means further comprises:

remotely actuated rotational means coupled between said implement mounting means and said mounted working implement for remotely actuated rotation of said mounted working implement with respect to said implement mounting means.

18. The adjustable implement adapter in accordance with claim 12, further comprising:

pressure plate means fixably attached to a lower rearward portion of said frame means adapted for engagement with a digging surface of said excavation tool.

19. The adjustable implement adapter in accordance with claim 12, said implement mounting means further comprising:

a rearward facing planar surface on each longitudinal end of said implement mounting means, each said rearward facing planar surface adapted to engage a mating parallel surface of a wear plate mounted on said working implements.

20. The adjustable implement adapter in accordance with claim 12, wherein said parking means is a distal end portion of said connecting means.

21. The adjustable implement adapter in accordance with claim 12, further comprising abutment means fixably mounted on said frame means for abutment upon a lower forward edge of said excavation tool.

22. An implement adapter for use in combination with an excavation thumb of a type having a first end pivotally connected to one of an excavation bucket and a boom arm, a rotationally displaceable second distal end, and hydraulic means mounted between said first and second ends for rotationally moving said excavation thumb relative to said one of said excavation bucket and said boom arm, said implement adapter comprising:

frame means for holding working implements;

coupling means integral with an upper portion of said frame means adapted for coupling to cooperative coupling means on said excavation thumb;

connecting means extending from a lower portion of said frame means adapted for connecting to said rotationally displaceable second distal end of said excavation thumb;

implement mounting means immovably secured to a lower portion of said frame means adapted for mounting working implements; and parking means extending a distance from a lower portion of said frame means for orienting said coupling means at a sufficient height above a surface when said implement adapter is supported on said surface by said parking means and a lowermost portion of said frame means, wherein said sufficient height enables engagement of said coupling means with said cooperative coupling means on said excavation thumb with no manual assistance.

23. The implement adapter in accordance with claim 22, wherein said coupling means further comprises two parallel spaced arms having a semi-circular bearing surface on a upper distal ends of each of said parallel spaced arms adapted for pivotal coupling with a mating circular element of said cooperative coupling means.

24. The implement adapter in accordance with claim 22, wherein said coupling means comprises coupling surfaces along a coupling rod adapted for pivotal coupling with at least one semi-circular bearing surface on said cooperative coupling means.

25. The implement adapter in accordance with claim 22, wherein said implement mounting means further comprises:

pivot means for enabling rotational movement of said mounted working implements about an axis orthogonal to the vertical axis of said frame means.

26. The implement adapter in accordance with claim 25, wherein said implement mounting means further comprises:

manual rotational indexing means coupled between said implement mounting means and said mounted working implement for manual rotation of said working implement with respect to said implement mounting means.

27. The implement adapter in accordance with claim 25, wherein said implement mounting means further comprises:

remotely actuated rotational means coupled between said implement mounting means and said mounted working implement for remotely actuated rotation of said mounted working implement with respect to said implement mounting means.

28. The implement adapter in accordance with claim 22, said implement mounting means further comprising:

a rearward facing planar surface on each longitudinal end of said implement mounting means, each said rearward facing planar surface adapted to engage a mating parallel surface of a wear plate mounted on said working implements.

29. The implement adapter in accordance with claim 22, wherein said parking means is a distal end portion of said connecting means.

30. The implement adapter in accordance with claim 22, wherein said frame means is adjustable in length along a first vertical axis, said coupling means is adjustable in length along a second horizontal axis, and said connecting means is adjustable in length along a third horizontal axis.

31. An implement adapter for use in combination with an excavation tool, said implement adapter comprising:

frame means for holding working implements;

coupling means integral with an upper portion of said frame means adapted for coupling to cooperative coupling means on said excavation tool;

connecting means extending from a lower portion of said frame means adapted for connecting to said excavation tool;

implement mounting means immovably secured to a lower portion of said frame means adapted for mounting working implements;

first rotating means mounted on said frame means for actuated rotation of said working implements about a first axis independent of said excavation tool motion and said frame means motion; and second rotating means mounted on said frame means for actuated rotation of said working implements about a second axis orthogonal to said first axis independent of said excavation tool motion and said frame means motion.

32. The implement adapter in accordance with claim 31, further comprising parking means extending a distance from a lower portion of said frame means for orienting said coupling means at a sufficient height above a surface when said implement adapter is supported on said surface by said parking means and a lowermost portion of said frame means, wherein said sufficient height enables engagement of said coupling means with said cooperative coupling means on said excavation tool with no manual assistance.

33. The implement adapter in accordance with claim 32, wherein said parking means is fixably attached to said connecting means and said second rotating means.

34. The implement adapter in accordance with claim 31, wherein said first and said second rotating means comprise remotely actuated mechanisms.

35. The implement adapter in accordance with claim 31, wherein said second rotating means comprises adjustable fastening means for angularly affixing said working implement about said second axis.

36. A method of machine mounting an implement adapter upon an excavation tool assembly, said implement adapter characterized by frame means for holding working implements, coupling means for coupling to cooperative coupling means on an upper portion of said excavation tool assembly, connecting means for connecting to a lower portion of said excavation tool assembly, implement mounting means for mounting working implements thereon, and parking means extending a distance from a lower portion of said frame means, the steps including:

resting said implement adapter upon a surface so that said parking means and one of a lower portion of said frame means and said implement mounting means contact said surface;

subjecting said coupling means to an upward moving cooperative coupling means of said excavation tool assembly;

subjecting said implement adapter to pivotal upward displacement about an axis collinear with one of said lower portion of said frame means and said implement mounting means simultaneous with and dependent upon the continuing engagement of said coupling means with said cooperative coupling means of said excavation tool assembly; and connecting said implement adapter to said excavation tool assembly.

* * * * *